US005203554A

United States Patent [19]

Suzuki et al.

[11] Patent Number: 5,203,554

[45] Date of Patent: Apr. 20, 1993

[54] PLURALITY DOCUMENT FEEDING APPARATUS AND METHOD FOR COPYING MACHINES

[75] Inventors: Kaoru Suzuki; Toru Morooka, both of Yamatokoriyama, Japan

[73] Assignee: Sharp Kabushiki Kaisha, Osaka, Japan

[21] Appl. No.: 755,624

[22] Filed: Sep. 5, 1991

[30] Foreign Application Priority Data

| | | | |
|---|---|---|---|
| Sep. 7, 1990 | [JP] | Japan | 2-237837 |
| Sep. 7, 1990 | [JP] | Japan | 2-237838 |
| Sep. 14, 1990 | [JP] | Japan | 2-245241 |

[51] Int. Cl.[5] ..... B65H 39/10; B65H 7/02

[52] U.S. Cl. ..... 271/10; 271/265; 271/291; 271/301; 271/186

[58] Field of Search ..... 271/3, 3.1, 4, 10, 186, 271/225, 265, 291, 301

[56] References Cited

U.S. PATENT DOCUMENTS

| | | | |
|---|---|---|---|
| 4,158,500 | 6/1979 | DiFrancesco et al. . | |
| 4,536,078 | 8/1985 | Ziehm | 271/3 |
| 4,896,876 | 1/1990 | Yamada et al. | 271/26 S |
| 4,974,827 | 12/1990 | Arai et al. | 271/186 |
| 5,056,775 | 10/1991 | Kida | 271/26 S |
| 5,085,418 | 2/1992 | Rapkin et al. | 271/3.1 |

FOREIGN PATENT DOCUMENTS

| | | | |
|---|---|---|---|
| 21665 | 1/1987 | Japan | 271/22 S |
| 231730 | 9/1989 | Japan | 271/3 |
| 236136 | 9/1989 | Japan | 271/3 |
| 236137 | 9/1989 | Japan | 271/3 |

*Primary Examiner*—Robert P. Olszewski
*Assistant Examiner*—Steven M. Reiss

[57] ABSTRACT

A document fed from a document loading tray is first transported into one branch transport path for inversion of the transporting direction thereof, and then is guided through the other branch transport path and transported on to a document scanning area. In this process, when the trailing edge of the inverted document has passed the branching point between the two transport paths, the feeding of a succeeding document toward said one transport path is initiated. Also, when the trailing edge of the inverted preceding document has passed the branching point, the transportation of the preceding document is temporarily stopped, during which time the transporting direction of the succeeding document is inverted. This allows the succeeding document to be brought close to the preceding document. At this time also, the feeding of a further succeeding document may be initiated. By thus transporting the documents one following close behind another, the transporting time of the documents and hence the copying time can be reduced.

8 Claims, 17 Drawing Sheets

Fig. 5 (1)
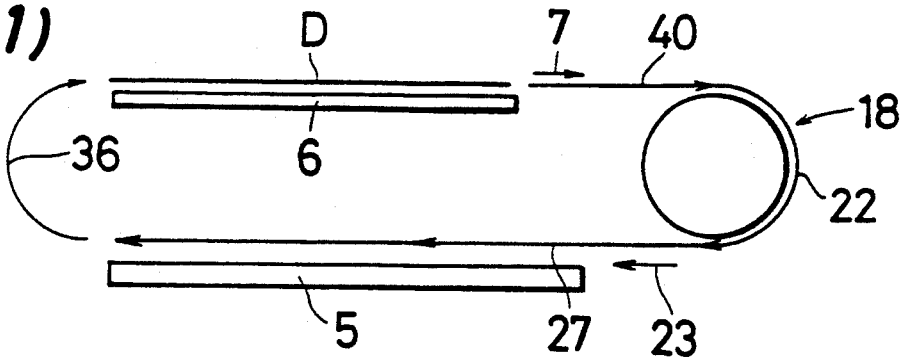
Fig. 5 (2)
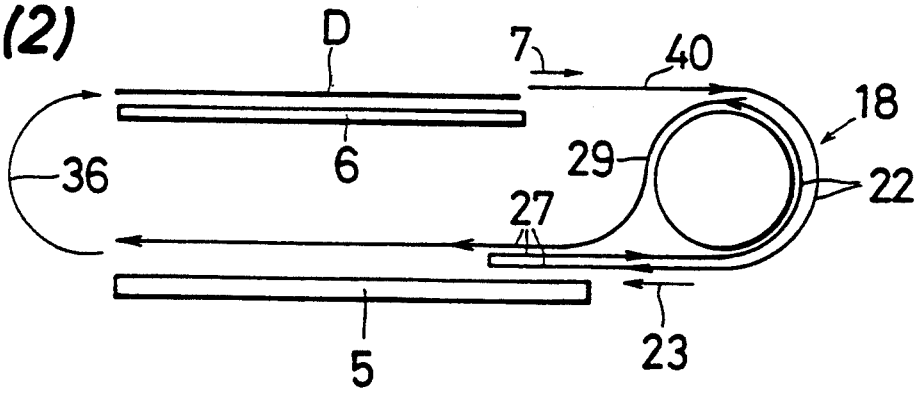

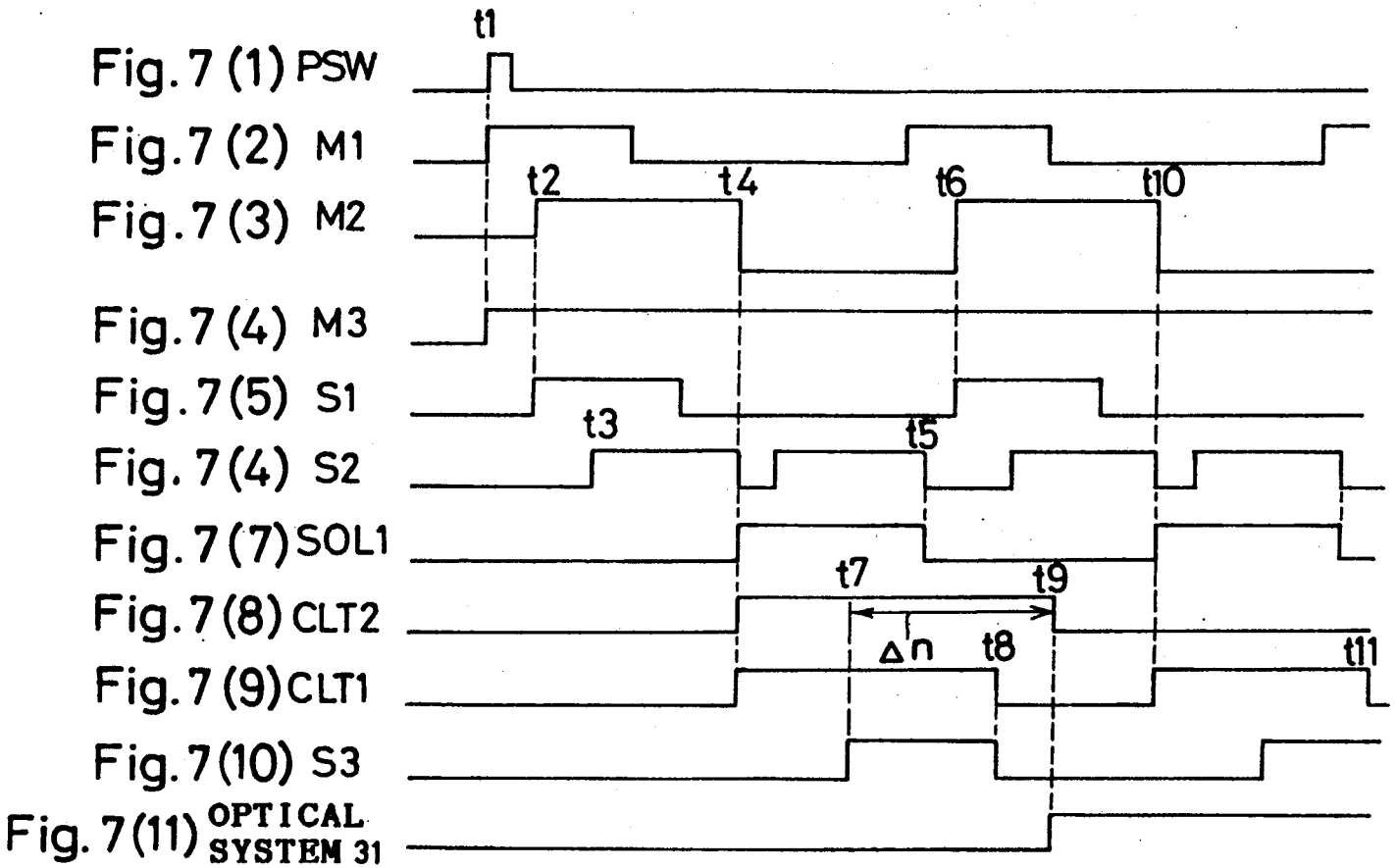
t1
t2
t3
t4
t5
t6
t7
t8
t9
t10
t11
Δn
Fig. 7 (1) PSW
Fig. 7 (2) M1
Fig. 7 (3) M2
Fig. 7 (4) M3
Fig. 7 (5) S1
Fig. 7 (4) S2
Fig. 7 (7) SOL1
Fig. 7 (8) CLT2
Fig. 7 (9) CLT1
Fig. 7 (10) S3
Fig. 7 (11) OPTICAL SYSTEM 31

Fig. 8 (1)
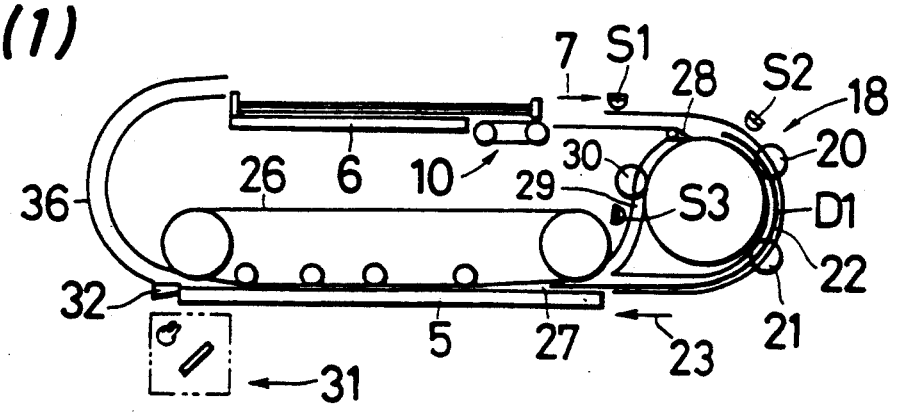
Fig. 8 (2)
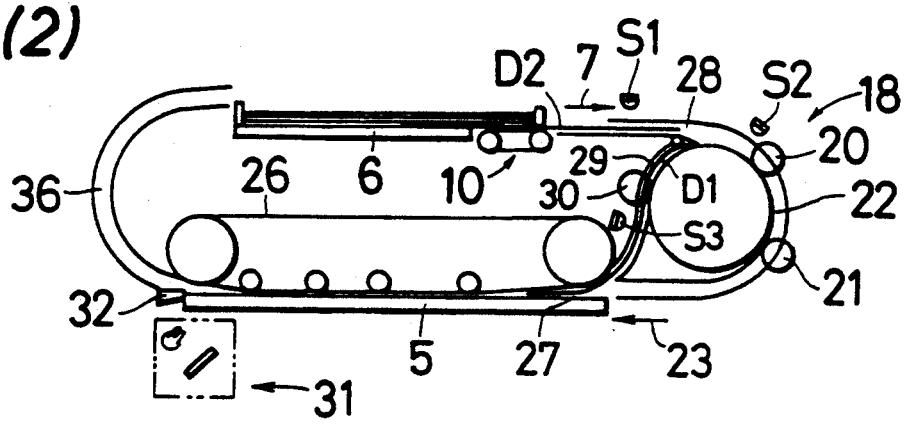
Fig. 8 (3)
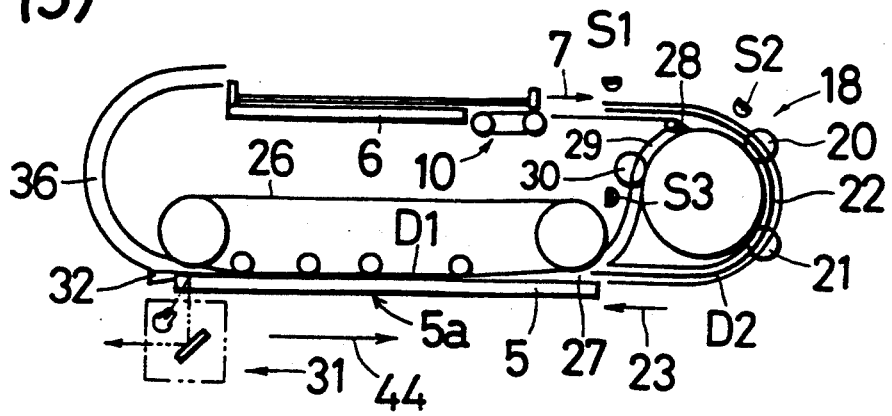

Fig. 8 (4)
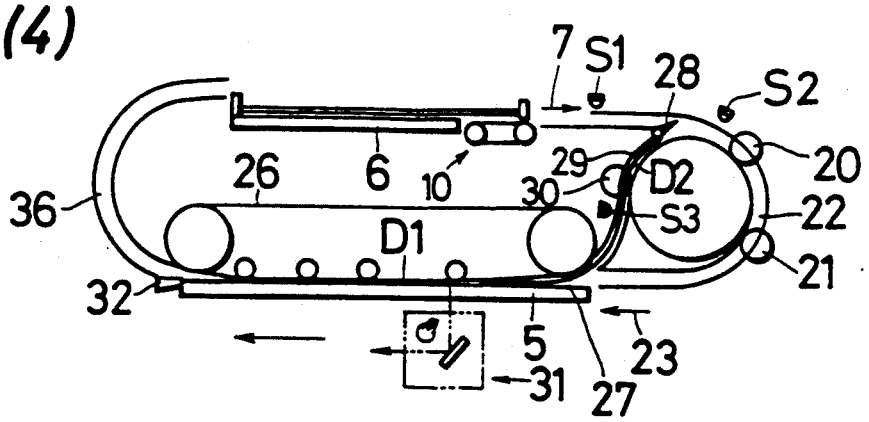
Fig. 8 (5)
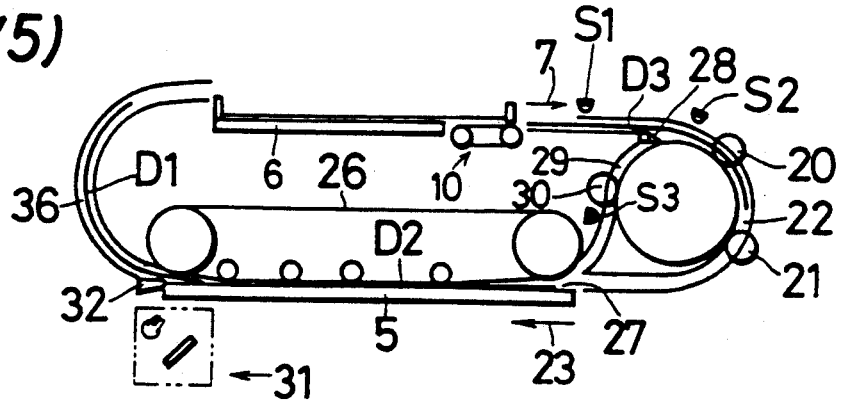
Fig. 8 (6)
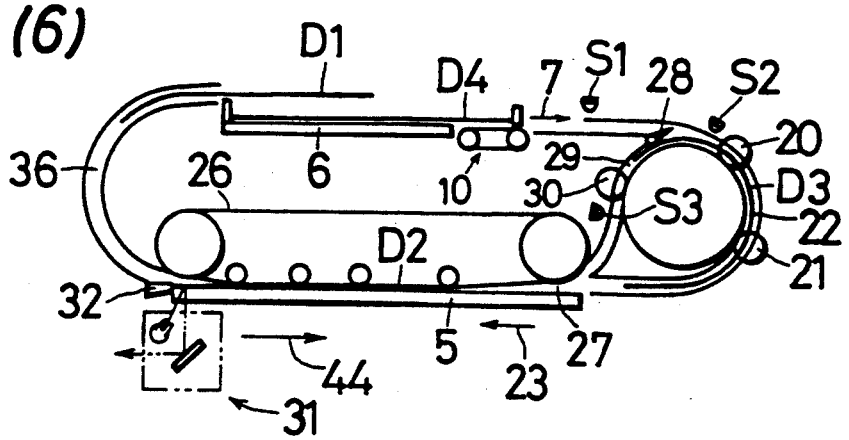

Fig.10(1) PSW
Fig.10(2) M1
Fig.10(3) M2
Fig.10(4) M3
Fig.10(5) S1
Fig.10(6) S2
Fig.10(7) S3
Fig.10(8) CLT1
Fig.10(9) CLT2
Fig.10(10) CLT3
Fig.10(11) SOL1

Fig.13(1) PSW
Fig.13(2) M1
Fig.13(3) M2
Fig.13(4) M3
Fig.13(5) S1
Fig.13(6) S2
Fig.13(7) S3
Fig.13(8) CLT1
Fig.13(9) CLT2
Fig.13(10) CLT3
Fig.13(11) SOL1
T1
T2
T3
t1
t2
t3
t4
t5
t6
t7
t8
t9
t10
t11
t12
t13
t14
t15

PLURALITY DOCUMENT FEEDING APPARATUS AND METHOD FOR COPYING MACHINES

BACKGROUND OF THE INVENTION

1. Field of the invention

The present invention relates to a document feeding method and a document feeding apparatus which may be advantageously employed in connection with for example, a copying machine for feeding a plurality of document sheets sequentially to a document scanning area where the documents are scanned for exposure.

2. Description of the Prior Art

It is well known in the prior art to provide copying machines with automatic document feeding apparatus for automatically feeding a plurality of document sheets in sequential fashion to a document scanning area thereby alleviating the work of the operator. Documents to be copied are stacked on a document loading tray and are fed for example sequentially from the bottom of the stack. The documents are transported by means of a transport belt sequentially to the document scanning area with the document image to be copied facing the interior side of the copying machine, and the thus positioned document image is scanned for example by an optical scanning means or the like, thus accomplishing simplex (single-sided) or duplex (two-sided) copying in cooperation with the copying machine.

FIG. 1 is a cross sectional view schematically showing the structure of a prior art document feeding apparatus 201. The documents d to be copied are stacked one on top of another on a document loading tray 206. On the downstream side of the document loading tray 206 in document transporting direction 207 there is disposed a document feeding means 210 for feeding the documents d one by one in sequential fashion. The document feeding means 210 comprises, for example, a suction transport means 211 disposed beneath the document loading tray 206 and an exhaust duct 212 disposed above the document loading tray 206.

The suction transport means 211 comprises: two drive rollers 213 and 214 each having an axis extending in a direction perpendicular to the transporting direction 207; and an endless belt 215 having numerous openings therein and passed around the two drive rollers 213 and 214 which are driven by a motor m1. A suction duct 216 is disposed inside the endless belt 215. When a suction fan, not shown, is driven, suction force is generated through the suction duct 216 and the suction force is applied through the belt 215 to suck the bottommost sheet of the stacked documents D onto the belt 215. Therefore, by rotating the drive rollers 213 and 214 in the clockwise direction in FIG. 1, the documents d are fed sequentially from the bottom of the stack in the transporting direction 207.

A stream of air is blown from the nozzle of the exhaust duct 212 toward the leading edges of the documents d in the lower part of the stack. This serves to separate the leading edges of the documents and thus ensures that the documents d are fed one by one by the suction transport means 211. The document d fed by the document feeding means 210 is transported along a transport path 240 and directed into an inverting means 218.

The inverting means 218 comprises: transport paths 222 and 229; paired transport rollers 220, 221, and 230; a diverting pawl 228; and motors m2 and m3. The transport path 240 branches in the vicinity of the diverting pawl 228 into the first transport path 222 curving in the clockwise direction and the second transport path 229 curving in the counterclockwise direction.

The transport rollers 220 and 221 are disposed on the first transport path 222 and are rotatable in both forward and backward directions by means of the motor m2. On the other hand, the pair of transport rollers 230 are disposed on the second transport path 229 and are driven by the motor m3. The diverting pawl 228 is driven, for example, by a solenoid. When the solenoid is deenergized, for example, a passage is opened for directing the document d from the transport path 240 into the first transport path 222. On the other hand, when the solenoid is energized, a passage is opened for directing the document d from the first transport path 222 into the second transport path 229.

The first transport path 222 and the second transport path 229 are reunited in the vicinity of the upstream end of a transparent plate 205 with respect to document transporting direction 223, the transparent plate 205 forming a document scanning area. The document d transported through the inverting means 218 in accordance with each preset copy mode is fed along the transporting direction 223 onto the transparent plate 205.

Above the transparent plate 205, there are disposed a pair of rollers **224*a* and 224*b* each having an axis extending parallel to the widthwise direction of the document d being transported, and a plurality of endless belts 226 are passed around the pair of rollers 224*a* and 224*b*. The roller 224*a* is driven by a motor m4. On the inside of the belts 226 and adjacent to the lower taut portions thereof are disposed a plurality of pressure rollers 225*a*–225*d* spaced apart along the transporting direction 223. The pressure rollers 225*a*–225*d* apply pressure to press the belts 226 against the transparent plate 205, thereby keeping the belts 226 from slacking while preventing the document d fed between the belts 226 and the transparent plate 205** from lifting.

The document d transported along the transparent plate 205 by means of the belts 226 is conveyed up to the scanning position on the transparent plate 205. The document d thus transported to the scanning position is positioned with its document image to be copied facing the interior side of the copying machine so that the document image is optically scanned by an optical system, the optical scanning means provided inside the copying machine, thus accomplishing the exposure of the document image.

While the preceding document is being scanned for exposure, preliminary feeding of a succeeding document is performed. The succeeding document is transported up to a standby position just before the transparent plate 205.

When the scanning of the document image is completed, the rotation of the belts 226 is restarted to transport the document d into a transport path 236. The document d is further transported by means of transport rollers 234 and 235 and returned to the top of the stack of documents d on the document loading tray 206.

In the above document feeding apparatus 201, the transport roller 230 and the roller **224*a* are driven by the different motors m3 and m4, respectively. Also, since the transport speed delivered by the transport roller 230 is slower than the transport speed by the belts 226, preliminary feeding of the document d does not result in the reduction of spacing between the documents on the transparent plate 205**. It is therefore not possible to reduce the total time needed to sequentially transport a plurality of documents to the document scanning area.

In order to transport and position the document first with one side thereof facing the document scanning area and then with the other side thereof facing it, as described above, there is provided, for example, an inverting means between the document loading tray and the document scanning area. The inverting means consists of a first and a second branch transport path provided between the document loading tray and the document scanning area. For simplex (single-sided) copying, the document fed from the document loading tray is turned over by passing through the first transport path and then transported with the image side thereof facing the document scanning area.

On the other hand, for duplex (two-sided) copying, the document fed from the document loading tray is first transported into the first transport path in which the transporting direction is inverted, and is then directed into the second transport path, after which the document is transported to the document scanning area. As a result, the document is positioned with the reverse thereof facing the document scanning area without having to turn back the document while placed on the document loading tray. After the reverse side has been scanned, the document is returned with its sides inverted, after which the document is refed through the first and second transport paths, thereby allowing the remaining side, i.e. the top side, of the document to be scanned for exposure.

In the above-described construction in which a plurality of document sheets are sequentially fed to the scanning area, the timing to feed a succeeding document that follows the preceding document greatly affects the time that the whole copying operation takes. Therefore, there can be considered a construction in which the succeeding document is preliminarily fed to a standby position as close as possible to the preceding document while the preceding document is resting on the document scanning area and is being scanned by the optical scanning means, thereby attempting to shorten the time needed to transport a plurality of documents sequentially to the document scanning area. The construction in which the succeeding document is preliminarily fed to a standby position as described above is generally known as preliminary feeding.

An example of the preliminary feeding is disclosed in Japan Patent Publication No. 62-12533. According to the construction disclosed therein, when sequentially feeding a plurality of documents to the transparent plate which serves as the document scanning area, the preliminary feeding and inverting of a document is started after the preceding document has been transported to its rest position on the transparent plate. This means that the start of the preliminary feeding is late. Therefore, in the case of relatively small size documents, for example, the preliminary feeding of the succeeding document may not be properly completed during the scanning of the preceding document on the scanning area.

Furthermore, in the above preliminary feeding, the succeeding document is placed on standby just before reaching the transparent plate and is not allowed to enter the area of the transparent plate while the preceding document is resting on the transparent plate. Therefore, in the case of relatively small size documents, for example, the succeeding document cannot be transported to stand by at a position sufficiently close to the preceding document.

Thus, because of a delay in the start of the preliminary feeding and the insufficiency of the preliminary feeding, a considerable limit is encountered when attempting to reduce the time needed to sequentially transport a plurality of document sheets to the document scanning area.

SUMMARY OF THE INVENTION

It is an object of the invention to provide a document feeding method, as well as a document feeding apparatus, which employs a simple control method and accomplishes a marked reduction in the time needed to transport a plurality of documents sequentially to a document scanning area by sufficiently reducing the transporting spacing between the preceding and succeeding documents and by achieving sufficient preliminary feeding.

To achieve the above object, the invention provides a document feeding method in which a plurality of document sheets sequentially fed from a document loading tray are first directed into one branch transport path for inversion of the transporting direction thereof and then transported in successive manner, via the other branch transport path, on to a document scanning area facing an optical scanning means, comprising the step of:

initiating the feeding of a succeeding document toward said one transport path immediately after the trailing edge of the inverted preceding document has passed the branching point between the two transport paths.

According to the invention, a document sheet fed from the document loading tray is first directed into one branch transport path for inversion of the transporting direction thereof and then transported via the other branch transport path and on to the document scanning area. This transport operation is sequentially performed on a plurality of documents so that the documents are transported one after another. In the invention, the feeding of a succeeding document toward said one transport path is initiated immediately after the trailing edge of the inverted preceding document has passed the branching point between the two transport paths.

Since the preliminary feeding of the succeeding document is started without delay, the succeeding document can be transported trailing close behind the preceding document, thereby assuring the completion of the preliminary feeding to the succeeding document to a standby position sufficiently close to the preceding document before the completion of the scanning of the preceding document on the document scanning area. As a result, the time needed to transport the succeeding document to the scanning area can be reduced significantly, which eventually leads to a reduction in the copying time.

According to the invention, a simple control method is employed for sequentially feeding a plurality of documents with one sheet closely followed by another. This assures the completion of proper preliminary feeding of a succeeding document sheet before the completion of the scanning of the preceding document sheet. Therefore, the time needed to transport the succeeding document to the document scanning area, and hence the total time needed to sequentially transport a plurality of documents to the document scanning area, can be significantly reduced, which eventually leads to a marked reduction in the copying time.

The invention also provides a document feeding method in which a plurality of document sheets sequentially fed from a document loading tray are first directed into one branch transport path for inversion of the transporting direction thereof and then transported in successive manner, via the other branch transport path, on to a document scanning area facing an optical scanning means, comprising the steps of:

stopping the transportation of a preceding first document sheet when the trailing edge thereof after inversion has passed the branching point between the two transport paths;

inverting the transporting direction of a succeeding second document sheet; and transporting the first and second document sheets together at the same speed when the leading edge of the inverted second document sheet comes to a predetermined distance from the trailing edge of the stationary first document sheet.

According to the invention, a document sheet fed from the document loading tray is first directed into one branch transport path for inversion of the transporting direction thereof and then transported via the other branch transport path and on to the document scanning area. This transport operation is sequentially performed on a plurality of document sheets so that the documents are transported one after another.

In the invention, when the trailing edge of the inverted first document sheet, the preceding document, has passed the branching point between the two transport paths, the transportation of the first document sheet is stopped and the inversion of the transporting direction of the succeeding second document sheet is initiated. As a result, the distance between the first and second document sheets is sufficiently closed. Thereafter, when the leading edge of the inverted second document sheet comes to a predetermined distance from the trailing edge of the stationary first document sheet, the first and second document sheets are transported together at the same speed. Therefore, the first document sheet can be transported to the document scanning area with the second document sheet following close behind, which serves to prevent the distance between the document sheets from widening due to the difference in transporting speed between the first and second document sheets as has been the case with the prior art.

This assures the preliminary feeding of the succeeding second document sheet to a standby position as close as possible to the preceding first document, thereby accomplishing a significant reduction in the time needed to transport the succeeding second document sheet to the document scanning area after the completion of the scanning of the preceding first document sheet, which eventually leads to a reduction in the copying time.

As described, according to the invention, a simple control method is employed for sequentially feeding a plurality of document sheets with one sheet closely followed by another. This assures the completion of proper preliminary feeding of a succeeding document sheet before the completion of the scanning of the preceding document sheet. Therefore, the time needed to transport the succeeding document sheet to the document scanning area, and hence the total time needed to sequentially transport a plurality of document sheets to the document scanning area, can be significantly reduced, which eventually leads to a marked reduction in the copying time.

The present invention further provides a document feeding method in which a plurality of document sheets sequentially fed from a document loading tray are first directed into one branch transport path for inversion of the transporting direction thereof and then transported in successive manner, via the other branch transport path, on to a document scanning area facing an optical scanning means, comprising the steps of:

stopping the transportation of a preceding first document sheet when the trailing edge thereof after inversion has passed the branching point between the two transport paths;

inverting the transporting direction of a succeeding second document sheet while at the same time transporting a further succeeding third document sheet up to a position near the branching point; and transporting the first and second document sheets together at the same speed when the leading edge of the inverted second document sheet comes to a predetermined distance from the trailing edge of the first document sheet.

According to the invention, a document sheet fed from the document loading tray is first directed into one branch transport path for inversion of the transporting direction thereof and then transported via the other branch transport path and on to the document scanning area. This transport operation is sequentially performed on a plurality of document sheets so that the document sheets are transported one after another.

In the invention, when the trailing edge of the inverted first document sheet, the preceding document, has passed the branching point between the two transport paths, the transportation of the first document sheet is stopped and the inversion of the transporting direction of the succeeding second document sheet is initiated. As a result, the distance between the first and second document sheets is sufficiently closed. Also, while the transporting direction of the second document sheet is being inverted, the further succeeding third document sheet is transported to a position near the branching point between the two transport paths.

Thereafter, when the leading edge of the inverted second document sheet comes to a predetermined distance from the trailing edge of the stationary first document sheet, the first and second document sheets are transported together at the same speed. The predetermined distance is selected so that when the first document sheet comes to a stop on the document scanning area, the inverted second document will stop at a position (the position at which the first document sheet had stopped) where the trailing edge thereof is past the branching point between the two transport paths.

Therefore, the first document sheet can be transported to the document scanning area with the second document sheet following close behind, thus preventing the distance between the document sheets from widening due to the difference in transporting speed between the first and second document sheets as has been the case with the prior art.

Furthermore, while the transportation of the second sheet is temporarily stopped, i.e. while the first document sheet is being scanned for exposure, the transporting direction of the third document sheet is inverted. As this is happening, a further document sheet succeeding the third document sheet is transported up to a position near the branching point between the two transport paths. This sequence of operations is repeated thereafter.

This permits the preliminary feeding of a succeeding document sheet to a standby position as close as possible to the preceding document, which serves to substantially reduce the time needed to transport the succeeding document sheet to the document scanning area after the completion of the scanning of the preceding document sheet, which eventually leads to a reduction in the copying time.

As described, according to the invention, a simple control method is employed for sequentially feeding a plurality of document sheets with one sheet closely followed by another. This assures the completion of proper preliminary feeding of a succeeding document sheet before the completion of the scanning of the preceding document sheet. Therefore, the time needed to transport the succeeding document sheet to the document scanning area, and hence the total time needed to sequentially transport a plurality of document sheets to the document scanning area, can be significantly reduced, which eventually leads to a marked reduction in the copying time.

The invention provides a document feeding apparatus comprising:

a document loading tray for holding a plurality of document sheets;

document feeding means for feeding the document sheets one by one from the document loading tray;

a first transport path along which the document sheets fed from the document feeding means are transported;

a second transport path formed continuously from the first transport path;

a third transport path diverging from the joint portion between the first and second transport paths and extending into a document scanning area facing an optical scanning means; and control means for transporting a preceding first document from the first transport path to the second transport path for inversion of the transporting direction thereof, the first document then being guided into the third transport path, and initiating the feeding of a succeeding second document toward the first transport path when the trailing edge of the inverted first document has passed the branching point of the third transport path.

The invention also provides a document feeding apparatus comprising:

a document loading tray for holding a plurality of document sheets;

document feeding means for feeding the document sheets one by one from the document loading tray;

a first transport path along which the document sheets fed from the document feeding means are transported;

a second transport path formed continuously from the first transport path;

a third transport path diverging from the joint portion between the first and second transport paths and extending into a document scanning area facing an optical scanning means; and control means for transporting a preceding first document from the first transport path to the second transport path for inversion of the transporting direction thereof, the first document then being guided into the third transport path; stopping the transportation of the inverted first document when the trailing edge thereof has passed the branching point of the third transport path, while at the same time inverting the transporting direction of a succeeding second document; and transporting the first and second documents together at the same speed when the leading edge of the inverted second document comes to a predetermined distance from the trailing edge of the stationary first document.

The invention further provides a document feeding apparatus comprising:

a document loading tray for holding a plurality of document sheets;

document feeding means for feeding the document sheets one by one from the document loading tray;

a first transport path along which the document sheets fed from the document feeding means are transported;

a second transport path formed continuously from the first transport path;

a third transport path diverging from the joint portion between the first and second transport paths and extending into a document scanning area facing an optical scanning means; and control means for transporting a preceding first document from the first transport path to the second transport path for inversion of the transporting direction thereof, the first document then being guided into the third transport path; stopping the transportation of the inverted first document when the trailing edge thereof has passed the branching point of the third transport path, while at the same time inverting the transporting direction of a succeeding second document and transporting a further succeeding third document up to a position near the branching point; and transporting the first and second documents together at the same speed when the leading edge of the inverted second document comes to a predetermined distance from the trailing edge of the stationary first document.

The invention is characterized in that a diverting pawl, which is switched between a first state that opens the passage from the first transport path to the second transport path and a second state that opens the passage from the second transport path to the third transport path, is provided at the branching point, the diverting pawl being set to the first state when transporting a document delivered from the document loading tray and to the second state when inverting the document transporting direction.

The invention is also characterized in that a transport roller rotatable in both forward and backward directions is provided in the second transport path, the transport roller being rotated in the forward direction when transporting a document delivered from the document loading tray and in the backward direction when inverting the document transporting direction.

Furthermore, the invention is characterized in that a first, a second, and a third document detector each comprising a light emitting element and a light receiving element are provided on the first, second, and third transport paths, respectively, in the vicinity of the branching point, each document detector normally off being switching on when light is blocked by a passing document and detecting the passing of one document sheet when the detector is switched back to the off state after a predetermined length of time, the diverting pawl and the transport roller being controlled in accordance with the detection result of each document detector.

BRIEF DESCRIPTION OF THE DRAWINGS

Other and further objects, features, and advantages of the invention will be more explicit from the following detailed description taken with reference to the drawings wherein:

FIGS. 5(1) and 5(2) are diagrams explaining how a document is transported in the document feeding apparatus shown for example in FIG. 2 in various copy modes;

FIGS. 7(1) to 7(11) timing chart explaining the document feeding operation according to a first embodiment of the invention;

FIGS. 8(1) to 8(6) is a series of diagrams explaining stepwise the transportation of the document;

DETAILED DESCRIPTION OF THE PREFERRED EMBODIMENTS

Figure 1:
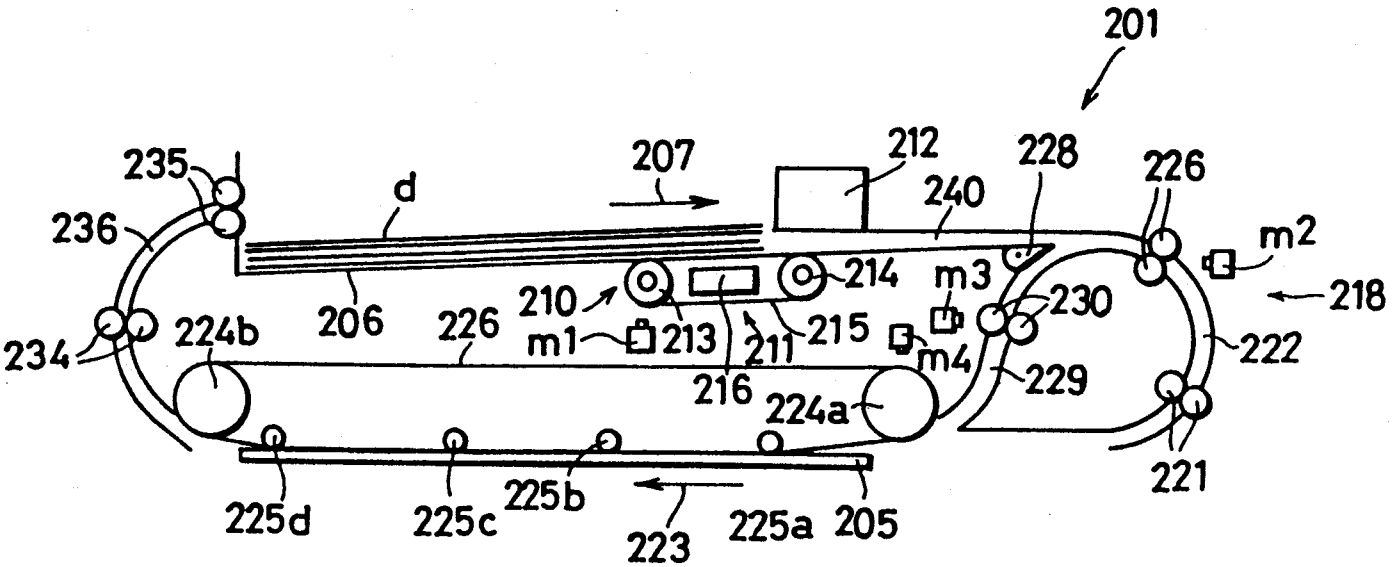
Fig. 1 Prior Art
FIG. 1 is a cross sectional view schematically showing the structure of a prior art document feeding apparatus.

Now referring to the drawing, preferred embodiments of the invention are described below.

Figure 2:
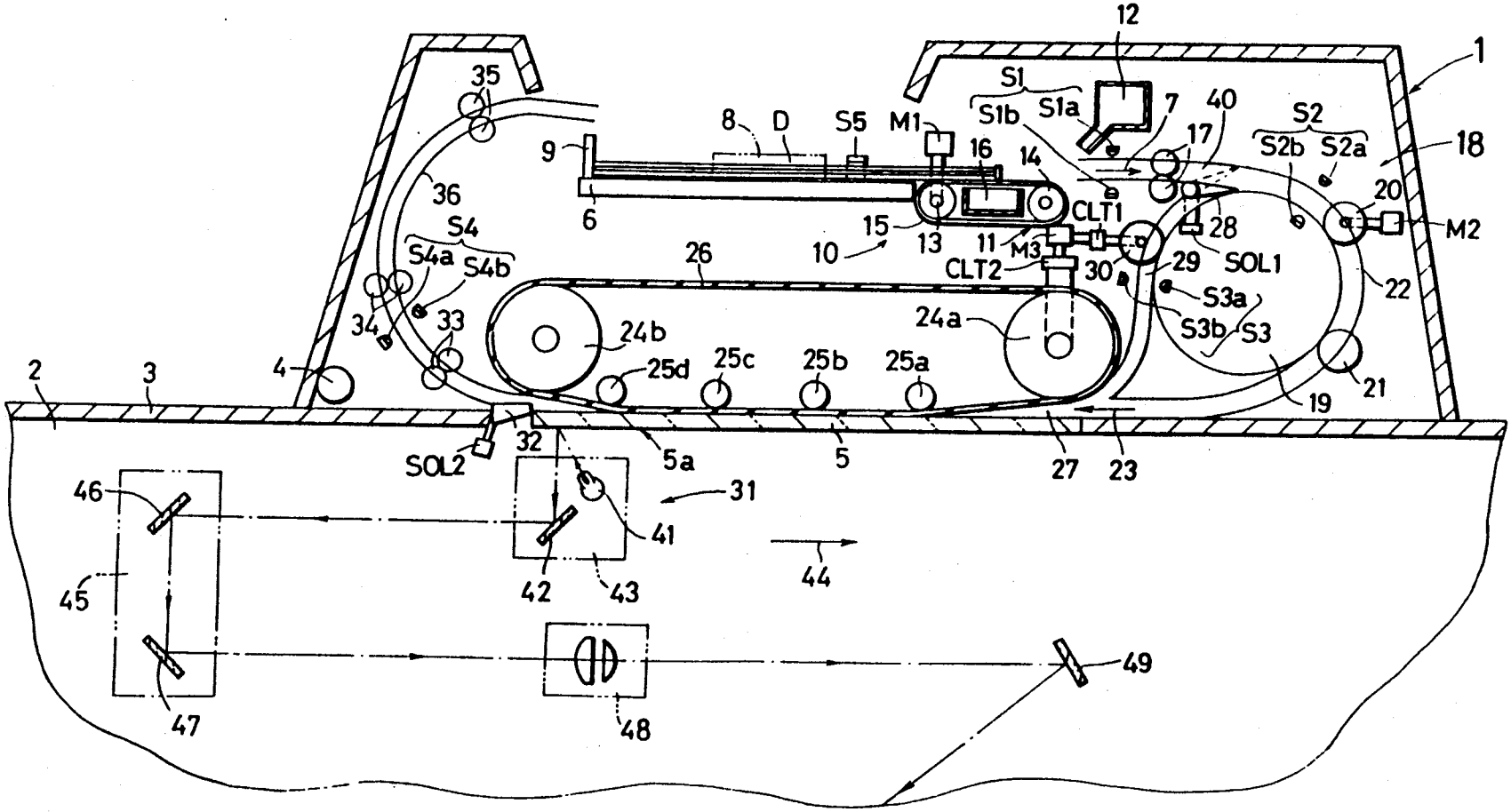
FIG. 2 is a cross sectional view schematically showing the structure of a document feeding apparatus in a first embodiment of the invention.
Figure 3:
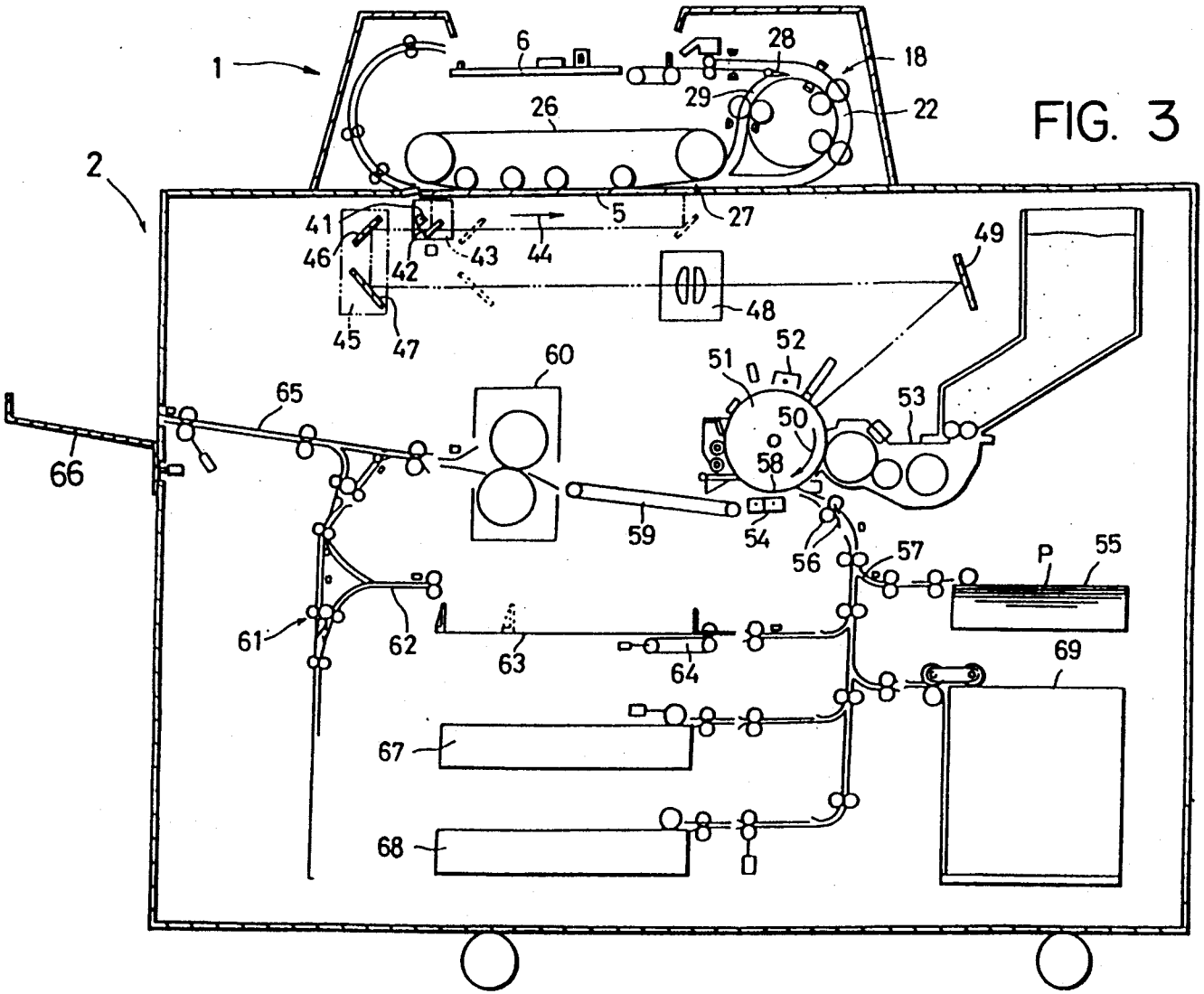
FIG. 3 is a cross sectional view schematically showing the structure of an electrostatic image transfer copying machine shown in FIG. 2 equipped with the document feeding apparatus.

FIG. 2 is a cross sectional view schematically showing the structure of a document feeding apparatus 1 in a first embodiment of the invention, and FIG. 3 is a cross sectional view schematically showing the structure of an electrostatic image transfer copying machine 2 equipped with the document feeding apparatus 1.

A transparent plate 5 formed from hard glass or other material is installed on the top surface 3 of the copying machine 2. The transparent plate 5 provides a document scanning area. The document feeding apparatus 1 is mounted above the transparent plate 5 and is fitted into the top surface 3, for example, in such a manner as to be rotatable about an axis of rotation 4. When the document feeding apparatus 1 is not used for feeding of documents (for example, when the document is a book or the like), the apparatus 1 is turned around about the axis of rotation 4 and the document is placed on the transparent plate 5 with the document image to be copied facing the interior side of the copying machine so that the copying operation is performed while the document is held pressed down thereon.

As shown in FIGS. 2 and 3, the document feeding apparatus 1 is usually mounted in such a manner as to cover the transparent plate 5 so that sheets of document D stacked on a document loading tray 6 are automatically fed in sequential fashion to a document scanning position 5*a* on the transparent plate 5 to present the document image for copying. The thus presented document image is optically scanned by an optical scanning means provided in the copying machine 2 for exposure of the document image. The document D whose image has been scanned is returned to the document loading tray 6 for storing therein. The above transport operation is sequentially performed on the documents D stacked on the document loading tray 6 so that the documents D are circulated in accordance with the required number of copies, thus accomplishing simplex (single-sided) or duplex (two-sided) copying on recording paper P.

With reference to FIG. 2, the structure of the document feeding apparatus 1 is described below.

The documents D to be copied are stacked on the document loading tray 6. The document loading tray 6 is provided with a pair of alignment plates 8 disposed opposite each other across the width of the stacked documents D which are fed in direction 7 parallel to the alignment plates 8. The alignment plates 8 are moved in opposite directions closer to or away from each other according to the widthwise size of the stacked documents D in order to align the widthwise sides of the documents D. As a result, the widthwise center of the stacked documents D is always at the same position regardless of the widthwise size thereof. Also, at the upstream end of the document loading tray 6 with respect to the transporting direction 7 of the stacked documents D, there is disposed a trailing edge alignment plate 9 for aligning the trailing edges of the stacked documents D.

Downstream of the document loading tray 6 in the transporting direction is disposed a document feeding means 10 for feeding the documents D one by one in sequential fashion. The document feeding means 10 comprises, for example, a suction transport means 11 disposed beneath the document loading tray 6 and an exhaust duct 12 disposed above the document loading tray 6. The suction transport means 11 comprises two drive rollers 13 and 14 each having an axis extending in a direction perpendicular to the transporting direction 7 and an endless belt 15 having numerous openings therein and passed around the two drive rollers 13 and 14. The drive rollers 13 and 14 are driven by a motor M1.

A suction duct 16 is disposed on the inside of the endless belt 15. When a suction fan not shown is driven, suction force is generated through the suction duct 16 and the suction force is applied through the belt 15 to suck the bottommost sheet of the stacked documents D onto the belt 15. Therefore, by rotating the drive rollers 13 and 14 in the clockwise direction (see FIG. 2), the documents D are sequentially fed from the bottom of the stack in the transporting direction 7.

A stream of air is blown from the nozzle of the exhaust duct 12 toward the leading edges of the documents D in the lower part of the stack. This serves to separate the leading edges of the documents and thus ensures that the documents D are fed one by one by the suction transport means 11. Thus, the stacked documents D are fed sequentially from the bottom of the stack by the document feeding means 10. It should be appreciated that the construction of the document feeding means 10 is not limited to the one described above.

The document D fed by the document feeding means 10 is transported along a first transport path 40 by means of transport rollers 17 and directed into an inverting means 18. Downstream of the document loading tray 6 in the document transporting direction is disposed a first transport detector S1 consisting, for example, of a light emitting element S1*a* and a light receiving element S1*b*. The first transport detector S1 detects one-by-one feeding of the documents D.

In FIG. 2, the inverting means 18 is formed around the outer surface of a support drum 19 which is substantially cylindrical in shape. The first transport path 40 that includes the transport rollers 17 branches into two paths when it reaches the outer surface of the support drum 9, one being a second transport path 22 curving clockwise (in FIG. 2) and the other being a third transport path 29 curving counterclockwise. In the second transport path 22, there are disposed transport rollers 20 and 21 which are driven by a motor M2 and rotatable in both forward and backward directions and which apply pressure to transport the document D along the outer surface of the support drum 19. The second transport path 22 is also provided with a second transport detector S2 consisting, for example, of a light emitting element S2*a* and a light receiving element S2*b*. The second transport detector S2 detects the transporting condition of the document D passing through the second transport path 22, based on which the rotating timing, direction, etc. of the transport rollers 20 and 21 are controlled.

In the third transport path 29, there is disposed a transport roller 30 which applies pressure to transport the document D along the outer surface of the support drum 19. The axle of the transport roller 30 is connected to a motor M3 via a clutch CLT1. Therefore, by controlling the engagement and disengagement of the clutch CLT1, the transport roller 30 is controlled so as to rotate in a prescribed direction or to stop the rotation. The third transport path 29 is also provided with a third transport detector S3 consisting, for example, of a light emittting element S3*a* and a light receiving element S3*b*. The third transport detector S3 detects the transporting condition of the document D passing through the third transport path 29, based on which the rotating timing and other parameters of the transport roller 30 are controlled.

A diverting pawl 28 which is driven by a solenoid SOL1 is disposed at a position where the first transport path 40 branches into the second and third transport paths 22 and 29. When the solenoid SOL1 is deenergized, for example, the passage is opened as shown by the solid line in FIG. 2 so that the document D is transported from the first transport path 40 into the second transport path 22. On the other hand, when the solenoid SOL1 is energized, the diverting pawl 28 is moved to the position shown by the dotted line, opening the passage for directing the document D from the second transport path 22 into the third transport path 29. The solenoid SOL1 is energized or deenergized depending for example on the detection result of the second transport detector S2.

The ends of the second and third transport path 22 and 29 opposite from the ends at which the diverting pawl is provided are united in the vicinity of the upstream end of the transparent plate 5 with respect to the transporting direction 23. Therefore, the document D transported through the inverting means 18 accordance with each individual copy mode set as hereinafter described is fed along the transporting direction 23 onto the transparent plate 5.

Above the transparent plate 5, there are disposed a pair of rollers 24*a* and 24*b* spaced apart along the transporting direction 23, each roller having an axis extending parallel to the widthwise direction of the document D being transported, and a plurality of endless belts 26 are passed around the pair of rollers 24*a* and 24*b*. The axle of the roller 24*a* is connected to the motor M3 via a clutch CLT2. Therefore, by controlling the engagement and disengagement of the clutch CLT2, the rotation of the belts 26 is switched on or off. On the inside of the belts 26 and adjacent to the lower taut portions 26*a* thereof are disposed a plurality of pressure rollers 25*a*–25*d* (four in this embodiment) spaced apart in this order along the transporting direction 23. The pressure rollers 25*a*–25*d* apply pressure to press the belts 26 against the transparent plate 5, thereby keeping the belts 26 from slacking while preventing the document D fed between the belts 26 and the transparent plate 5 from lifting.

Furthermore, a clearance 27 is formed on the upstream side of the transparent plate 5 with respect to the document transporting direction 23 as a result of the difference in elevation between the support position of the belts 26 on the roller 24*a* and that of the belts 26 on the pressure roller 25*a*. That is, upstream of the pressure roller 25*a*, the belt 26 are stretched forming a prescribed angle $\theta$ to the transparent plate 5 as measured at the pressure roller 25*a*.

The clearance 27 is formed continuously from the second and third transport paths 22 and 29 of the inverting means 18. Therefore, the document D can be fed into the clearance 27 by means of the transporting force of the transport rollers 20, 21, and 30 of the inverting means 18 even when the rotation of the belts 26 is stopped.

The document D transported along the transparent plate 5 by means of the belts 26 is conveyed up to the scanning positioned 5*a* on the transparent plate 5. The scanning position 5*a* refers to the position at which the leading edge of the thus transported document D contacts a protruding stop member 32 disposed near the downstream end of the transparent plate 5 in the transporting direction 23. The document D thus transported to the scanning position 5*a* is position with its document image to be copied facing the interior side of the copying machine so that the document image is optically scanned by an optical system 31, the optical scanning means provided inside the copying machine 2, thus accomplishing the exposure of the document image.

While the preceding document is being scanned for exposure, preliminary feeding of a succeeding document is performed. The preliminary feeding is completed when the succeeding document has been fed into the clearance 27 to stand by for the next operation. The distance between the stop member 32 and the pressure roller 25*a* which the leading edge of the preliminarily fed document reaches is appropriately selected so that the distance is sufficiently great to accommodate the transported document regardless of the document size and so that the succeeding document is prevented from coming into contact with the preceding document.

When the scanning of the document image is completed, the stop member 32 is retracted by means of a solenoid SOL2 to open the passage leading from the scanning position 5a to a transport path 36. At the same time, the belts 26 are restarted to rotate, and the document D is transported along the transport path 36 by means of transport rollers 33–35 and returned to the top of the stack of documents D on the document loading tray 6.

The transport path 36 is provided with a document discharge detector S4, etc., comprising, for example, a light emitting element S4a and a light receiving element S4b. The document discharge detector S4 detects the transporting condition of the document D being transported along the transport path 36, based on which the energization timing and other parameters of the solenoid SOL2 are controlled. Also, a circulation detector S5 for detecting one circulation cycle of the stacked documents D is disposed in the vicinity of the document loading tray 6. The circulation detector S5 comprises, for example, and actuating member that contacts the top of the stacked documents D and determines that all the documents D have been fed to complete one circulation cycle when the absence of the documents D between the actuating member and the document loading tray 6 is, for example, optically detected.

As described, the document image presented at the scanning position 5a is scanned by the optical system 31 for exposure. In the optical system 31, a first moving unit 43 containing a light source 41 such as a halogen lamp and a reflecting mirror 42 reciprocates in horizontal direction 44 along the length of the scanning position 5a to illuminate the presented document. The light from the document is reflected into reflecting mirrors 46 and 47 in a second moving unit 45 and then into a zoom lens 48 which then transmit it to a reflecting mirror 49 and on to a photoreceptor 51 of a right circular cylindrical shape which is rotating in the direction indicated by arrow 50. The second moving unit 45 is also moved in the same direction but at half the travelling speed of the first moving unit 43 so that the light path length of the reflected light is maintained constant.

An electrostatic latent image corresponding to the thus projected document image is formed on the outer circumferential surface of the photoreceptor 51 which has previously been charged by a charge corona discharger 52. The electrostatic latent image is then developed into a toner image by means of a developing unit 53 and is transferred onto one side of recording paper P by means of a transfer corona discharger 54. Prior to this process, the recording paper P fed from a paper cassette 55 has been transported along a transport path 57 having a pair of resist rollers 56 to a transfer station 58 where the transfer is performed.

A power transmitting means is connected to the axle of the resist roller 56 via a clutch CLT3 not shown. By controlling the engagement and disengagement of the clutch CLT3 in conjunction with the control of the transport timing of the document D in the document feeding apparatus 1, it is possible to match up the timing for the resist rollers 56 to transport the recording paper P with respect to the toner image on the photoreceptor 51. The recording paper P onto which the toner image has been transferred by the transfer corona discharger 54 is transported via a transport means 59 to a fixing unit 60 where the toner image is fixed to the recording paper P.

After the fixing, the recording paper is passed through a recording paper inverting means 61 by which the transporting direction of the recording paper P is inverted, after which the recording paper P is transported through a transport path 62 and fed into an intermediate tray 63 for temporary storage. The recording paper P stored in the intermediate tray 63 is fed back to the transfer station 58 by means of a transport means 64 and the resist rollers 56 so that a toner image is transferred to the other side of the recording paper P. After the transfer, the recording paper P is transported via the transport means 59, the fixing unit 60, and the transport path 65 and is discharged onto an exit tray 66 outside the copying machine. Thus, the corresponding document images are copied on the respective sides of the corresponding recording paper P. On the other hand, when making a simplex (single-sided) copy, the recording paper P with the image copied on one side thereof is discharged onto the exit tray 66 instead of being directed to the intermediate tray 63. The paper cassettes 55, 67, 68, and 69 respectively hold recording paper P of different sizes, for example, and the proper size paper is selected for transportation to the transfer station 58.

Figure 4:
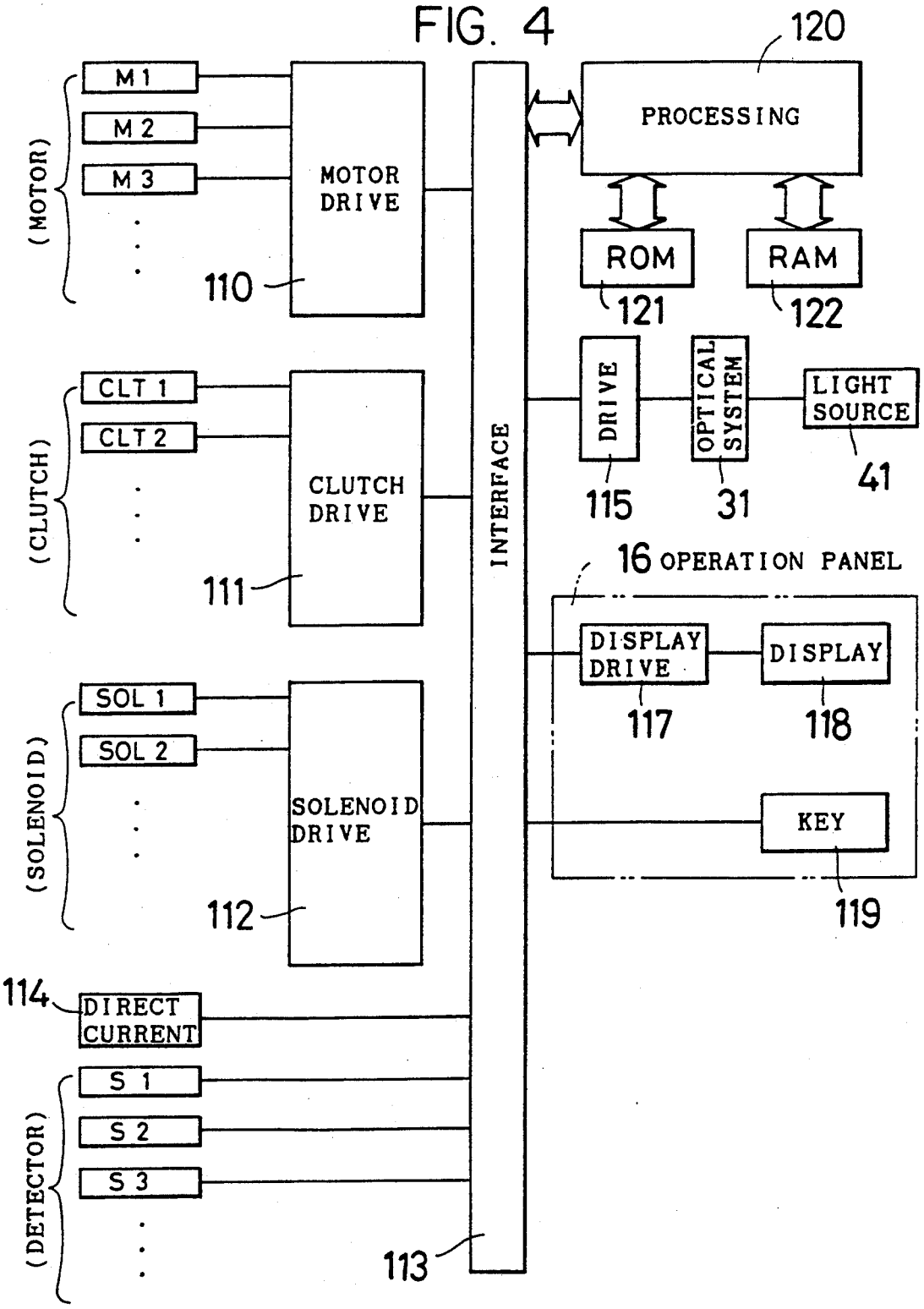
FIG. 4 is a block diagram illustrating the electrical configuration of the document feeding apparatus and copying machine.

FIG. 4 is a block diagram illustrating the electrical configuration of the document feeding apparatus 1 and copying machine 2. Various motors including the motors M1, M2 and M3 for driving the plurality of rollers, etc. are connected to a motor driving circuit 110, various clutches including the clutches CLT1, CLT2 and CLT3 for controlling the transport roller 30, belt 26, etc. are connected to a clutch driving circuit 111, and various solenoids including the solenoids SOL1 and SOL2 for controlling the diverting pawl 28, the stop member 32, etc. are connected to a solenoid driving circuit 112. These driving circuits 110–112 and control elements, such as a DC power supply 114, for controlling the document transportation, recording paper transportation, and copy process are connected to an interface circuit (I/O) 113. The various detectors S1, S2, etc. for detecting the document D and recording paper P being transported are also connected to the interface circuit 113 to which a microcomputer (CPU) 120 is connected. Signals from the detectors are supplied to the microcomputer 120 which performs necessary operations on these signals and supplies drive control signals to the respective driving circuits 110–112 via the interface circuit 113.

A read-only memory (ROM) 121 and a random-access memory (RAM) 122 are connected to the microcomputer 120. Using a memory area in the RAM 122 as a work area, the microcomputer 120 performs control operations in accordance with control programs stored in the ROM 121.

The optical system 31 is connected to the interface circuit 113, via a driving circuit 115, which drives the light source 41 and supplies display control signals to various display parts on an operation panel 116 via a display driving circuit 117. Operation keys 119 are also connected to the interface circuit 113.

The following describes how the document feeding apparatus 1 operates to transport the document D in various copy modes.

FIG. 5(1) shows how a simplex (single-sided) document D is transported. For convenience sake, the positional relations between the document loading tray 6, the transparent plate 5, and the inverting means 18 are shown in a simplified form in FIG. 5(1). The simplex (single-sided) documents D to be copied are stacked on the document loading tray 6 with their image side facing upward. As the diverting pawl 28 is locked into position as shown by the solid line in FIG. 2, the document D fed from the bottom of the stack is transported into the second transport path 22 of the inverting means 18.

The document D passed through the second transport path 22 is guided through the clearance 27 formed on the upstream side of the transparent plate 5 with respect to the transporting direction, and is transported on to the scanning position 5*a*. By passing through the inverting means 18, the document D placed face up on the document loading tray 6 is inverted or turned over to present its document image on the scanning position 5*a*. After the presented document image has been scanned by the optical system 31, the belts 26 are restarted so that the document D is transported along the transport path 36 and returned to the top of the stack of documents D on the document loading tray 6. Thus, the image of the simplex (single-sided) document fed to the scanning position 5*a* is scanned for exposure as described above, producing a simplex (single-sided) or duplex (two-sided) copy on recording paper P with the document feeding apparatus 1 cooperating with the copying machine 2.

In order to sequentially feed a plurality of documents to the scanning position 5*a*, it is necessary to preliminarily feed a document, that succeeds the preceding document, to a standby position as close as possible to the preceding document currently being scanned. Since the clearance 27 is formed on the transparent plate 5 continuously with the second transport path 22, the succeeding document can be preliminarily fed until the leading edge thereof reaches a point near the pressure roller 25*a* at the downstream end of the clearance 27, thus positioning the succeeding document on standby sufficiently close to the preceding document.

FIG. 5(2) shows how a duplex (two-sided) document is transported. The duplex (two-sided) documents D having document images on both sides for copying are stacked on the document loading tray 6 with their page numbers collated, for example, from top to bottom of the stack. The document D fed from the bottom of the stack is transported to the inverting means 18. The diverting pawl 28 is first set as shown by the solid line in FIG. 2, so that the document D is transported along the second transport path 22 and into the clearance 27.

When the trailing edge of the document D being transported along the second transport path 22 in the transporting direction 7 has passed the diverting pawl 28 thereby activating the second transport detector S2, for example, the transport rollers 20 and 21 on the second transport path 22 are driven for rotation in the reverse direction while the diverting pawl 28 is moved to the position indicated by the dotted line in FIG. 2. As a result, the document D is fed in the opposite direction and transported from the second transport path 22 to the third transport path 29 and on to the clearance 27 via which the document D is guided to the scanning position 5*a* on the transparent plate 5. Thus, the document D fed from the document loading tray 6 is positioned so as to present its one side on the scanning position 5*a* for scanning.

After its one side has been scanned, the document D is inverted through the transport path 36 and returned to the top of the stack of documents D on the document loading tray 6. The above process is repeated until one side of every document stacked on the document loading tray 6 has been presented for copying. In the meantime, recording paper sheets P each with one side of the corresponding document copied thereon are sequentially stacked on the intermediate tray 63 inside the copying machine 2.

Next, the transport operation as shown in FIG. 5(2) is repeated on the documents D that have been returned and stacked on the document loading tray 6, so that the other side of each document D that has not yet been copied is presented for exposure at the scanning position 5*a*. The other side of each document is scanned for copying onto the fresh opposite side of the corresponding recording paper P sequentially fed from the bottom of the stack on the intermediate tray 63, thus sequentially generating the recording paper P having corresponding images copied on both sides thereof. Each document D the other side of which has been scanned is again inverted through the transport path 36 and is returned to the top of the stack of documents on the document loading tray 6. Thus, the documents D circulated twice through the document feeding apparatus 1 are stacked in the same collated order as when they were stacked initially.

In transporting the duplex (two-sided) documents D also, it is necessary to perform preliminary feeding to reduce the copying time by feeding the succeeding document to a standby position as close as possible to the preceding document being scanned. Since the clearance 27 continuing from both the second transport path 22 and the third transport path 29 is provided on the transparent plate 5, the document D passed through the third transport path 29 can be fed in the transporting direction 23 until the leading edge thereof reaches a point near the pressure roller 25*a* at the downstream end of the clearance 27, thus accomplishing preliminary feeding to bring the document D sufficiently close to the preceding document.

Also, according to the invention, the preliminary feeding of the succeeding document is initiated immediately after the inverted preceding document has been transported into the third transport path 29 from the second transport path 22. By thus initiating the preliminary feeding, the succeeding document can be transported trailing close behind the preceding document, so that the preliminary feeding will be completed without fail before the completion of the scanning of the preceding document on the scanning position 5*a*.

Figure 6:
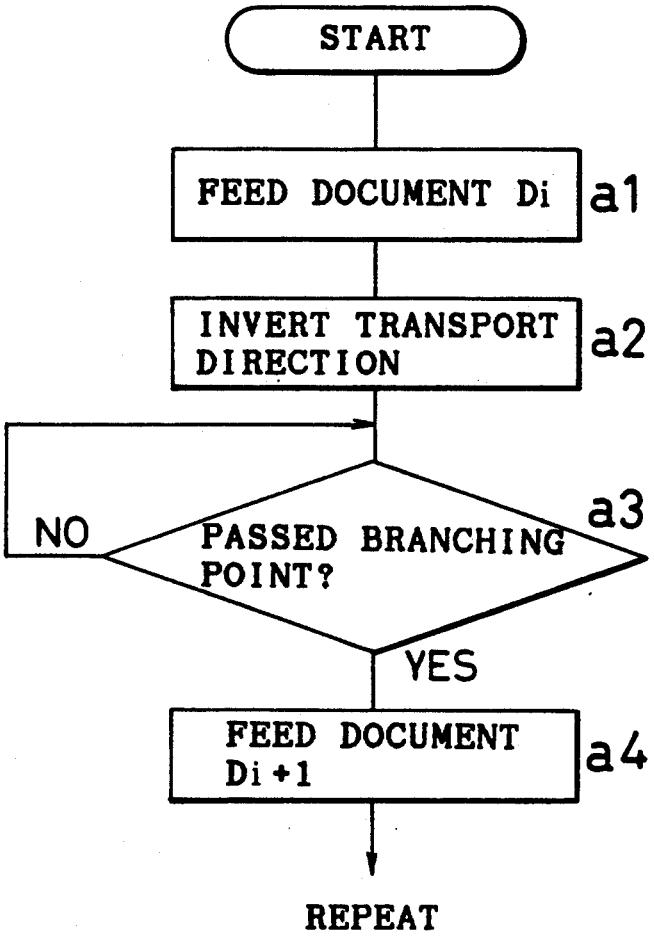
FIG. 6 is a flowchart explaining in outline the document feeding operation according to the first embodiment.

FIG. 6 is a flowchart explaining in outline the document feeding operation according to this embodiment. In step a1, a document Di ($i=1,2,\ldots$) is fed, and in step a2, the transporting direction of the document Di is inverted. When, in step a3, the trailing edge of the inverted document Di is detected to have passed the branching point at which the diverting pawl 28 is provided, the feeding of the next document Di+1 is started in step a4. Thereafter, the above process is repeated.

FIG. 7 is a timing chart explaining in detail the document feeding operation according to this embodiment, and FIG. 8 is a series of diagrams explaining stepwise the transportation of the document D. Referring to FIGS. 7 and 8, the following describes an example of document feeding operation according to this embodiment. FIG. 8 illustrates a case in which four documents D are presented for copying, and the numbers 1–4 suffixed to the reference sign D correspond to the order in which the documents D are fed from the document loading tray 6.

When the duplex (two-sided) documents D1–D4 are placed on the document loading tray 6 with their page numbers collated and the print switch PSW is pressed at time t1, the copy operation is initiated and the feeding of the document D is started. As shown in FIG. 7, the motors M1 and M3 are started at the same time that the print switch PSW is pressed. The motor M1 runs for a limited length of time during which the paper feeding means 10 is driven to feed the document D1 from the bottom of the stack on the document loading tray 6. The motor M3 continues to run until the copy operation is stopped, and drives the transport roller 30 and the belts 26 as required as the clutches CLT1 and CLT2 are controlled to engage and disengage.

At time t2, the first transport detector S1 is activated as the leading edge of the document D1 fed in the transporting direction 7 is detected. In synchronism with the activation of the first transport detector S1, the motor M2 is driven for rotation in the forward direction so that the transport rollers 20 and 21 are rotated in such a direction as to transport the document D1 clockwise around the support drum 19. With the solenoid SOL1 in the deenergized state, the diverting pawl 28 is set in the position shown by the solid line in FIG. 2 so that the passage leading from the first transport path 40 to the second transport path 22 is opened. Therefore, the document D1 is directed to the second transport path 22, and at time t3, the second transport detector S2 is activated as the leading edge of the document D1 being transported in the transporting direction 7 is detected. FIG. 8(1) shows the condition immediately after time t3 at which the document D1 is transported into the second transport path 22.

The first transport detector S1 is deactivated after a length of time corresponding to the size of the document D1 thus transported. At time t4, the second transport detector S2 is also deactivated, which means that the trailing edge of the document D1 transported in the transporting direction 7 has passed the second transport detector S2. At time t4, the motor M2 is driven for rotation in the reverse direction, and at the same time, the solenoid SOL1 is energized. As a result, the diverting pawl 28 is moved to the position indicated by the dotted line in FIG. 2, thereby opening the passage leading from the second transport path 22 to the third transport path 29.

Furthermore, at time t4, the clutches CLT1 and CLT2 are engaged so that the rotating force of the motor M3 is transmitted to drive the transport roller 30 and the belts 26. As the motor M2 is driven in the reverse direction, the transporting direction of the document D1 is inverted so that the document D1 is transported from the second transport path 22 to the third transport path 29, the transporting speed being increased up to the speed equal to the rotating speed of the transport roller 30. As the transporting direction is inverted, the second transport detector S2 is activated once again when the leading edge of the inverted document D1 passes it, and deactivated at time t5 when the trailing edge thereof passes it. Also at time t5, the solenoid SOL1 is deenergized.

In this embodiment, the preliminary feeding of the succeeding document D2 is started in such a manner that the succeeding document D2 is fed toward the second transport path 22, as shown in FIG. 8(2), immediately after the trailing edge of the document D1 the transporting direction of which has been inverted in the second transport path 22 has passed the diverting pawl 28. To accomplish this, the motor M1 that drives to feed the document D2 is started before time t5, and at time t6, the first transport detector S1 is activated. To transport the succeeding document D2 along the second transport path 22, the motor M2 is driven again for rotation in the forward direction at time t6, thus transporting the document D2 along the second transport path 22. Thus, by coordinating the transport mechanisms in the transport paths 22 and 29, the successively fed documents D1 and D2 are transported one trailing closely behind the other.

With the clutches CLT1 and CLT2 engaged at time t4, the document passed through the third transport path 29 is transported through clearance 27 and conveyed up to the scanning position 5a by the rotation of the belts 26. As the document is transported into the third transport path 29, the third transport detector S3 is activated at time t7, which occurs before time t5, and is deactivated at time t8 after a length of time corresponding to the size of the document. When the document D1 has passed through the third transport path 29, which is detected by the deactivation of the third transport detector S3, the clutch CLT1 is disengaged to temporarily stop the rotation of the transport roller 30 which then acts as a resist roller to provide a standby position for the succeeding document D2.

Further, at time t9 when a prescribed number of pulses Δn have been counted for example by a rotary encoder or the like after time t7, the clutch CTL2 is disengaged to stop the rotation of the belts 26, thus completing the transportation of the document D1 to the scanning position 5a. FIG. 8(3) shows the condition at time t9 when the transportation of the document D1 to the scanning position 5a is complete. At this time, the inverting operation by the inverting means 18 is already under way to invert the transporting direction of the preliminary fed succeeding document D2.

Upon completion of the transportation to the scanning position 5a, the optical scanning by the optical system 31 is started, the optical system 31 moving in the direction indicated by arrow 44. While the document D1 is thus being scanned for exposure, the inverting operation for the succeeding document D2 is continued, and at time t10, the second transport detector S2 is deactivated and the transport rollers 20 and 21 are rotated in the reverse direction. At the same time, the solenoid SOL1 is energized so that the document D2 is guided into the third transport path 29. Also, at time t10, the clutch CLT1 is engaged once again, to transport the document D2 along the third transport path 29.

Thereafter, at an appropriate time t11, the clutch CLT1 is disengaged so that the document D2 stops with its trailing edge pressed by the transport roller 30. As a result, the succeeding document D2 is placed on standby at a position sufficiently close to the preceding document D1, thus completing the preliminary feeding of the document D2. FIG. 8(4) shows the condition when the preliminary feeding is completed. As shown, the document D2 has reached the standby position before the scanning of the preceding document D1 is completed. That is, since the preliminary feeding is started as earlier mentioned to transport the succeeding document D2 following close behind the preceding document D1, the preliminary feeding of the succeeding document D2 can be completed without fail before the completion of the scanning of the preceding document D1.

In the condition shown in FIG. 8(4), the trailing edge of the document D2 pressed by the transport roller 32 is in partial contact with the diverting pawl 28. If the size of the document D2 is such that the trailing edge is past the diverting pawl 28, the preliminary feeding of a further succeeding document D3 may be started immediately to transport the document D3 into the second transport path 22.

When the scanning of the document D1 is completed, the solenoid SOL2 is energized to open the passage leading to the transport path 36, and the clutches CLT1 and CLT2 are engaged once again. As a result, as shown in FIG. 8(5), the document D1 is discharged from the scanning position 5a, while at the same time, the succeeding document D2 is transported from the standby position to the scanning position 5a. Thereafter, as shown in FIG. 8(6), the document D1 is returned to the top of the stack, i.e. on top of the uppermost document D4, on the document loading tray 6. In the meantime, the document D2 is transported to the scanning position 5a, and the transporting direction of the preliminarily fed document D3 is inverted by the inverting means 18. The above sequence of operations is performed sequentially on the successively fed documents D1–D4.

Thus, according to the invention, the transporting forces of the transport paths are individually controlled and effectively coordinated so that the succeeding document can be transported following close behind the preceding document. Therefore, the preliminary feeding of the succeeding document can be completed without fail, with the succeeding document positioned as close as possible to the preceding document, while the preceding document is being scanned for exposure. As a result, the distance that the succeeding document needs to travel to reach the scanning position, and hence the length of time needed to transport the document to that position, is markedly reduced, which eventually leads to a significant reduction in the total time needed to sequentially transport a plurality of documents to the scanning position. Accordingly, the copying time can be reduced markedly.

The above embodiment has been described in connection with the construction of an electrostatic image transfer copying machine, but it will be appreciated that this embodiment can also be applied to a construction in which copying is made, for example, on photosensitized recording paper.

Figure 9:
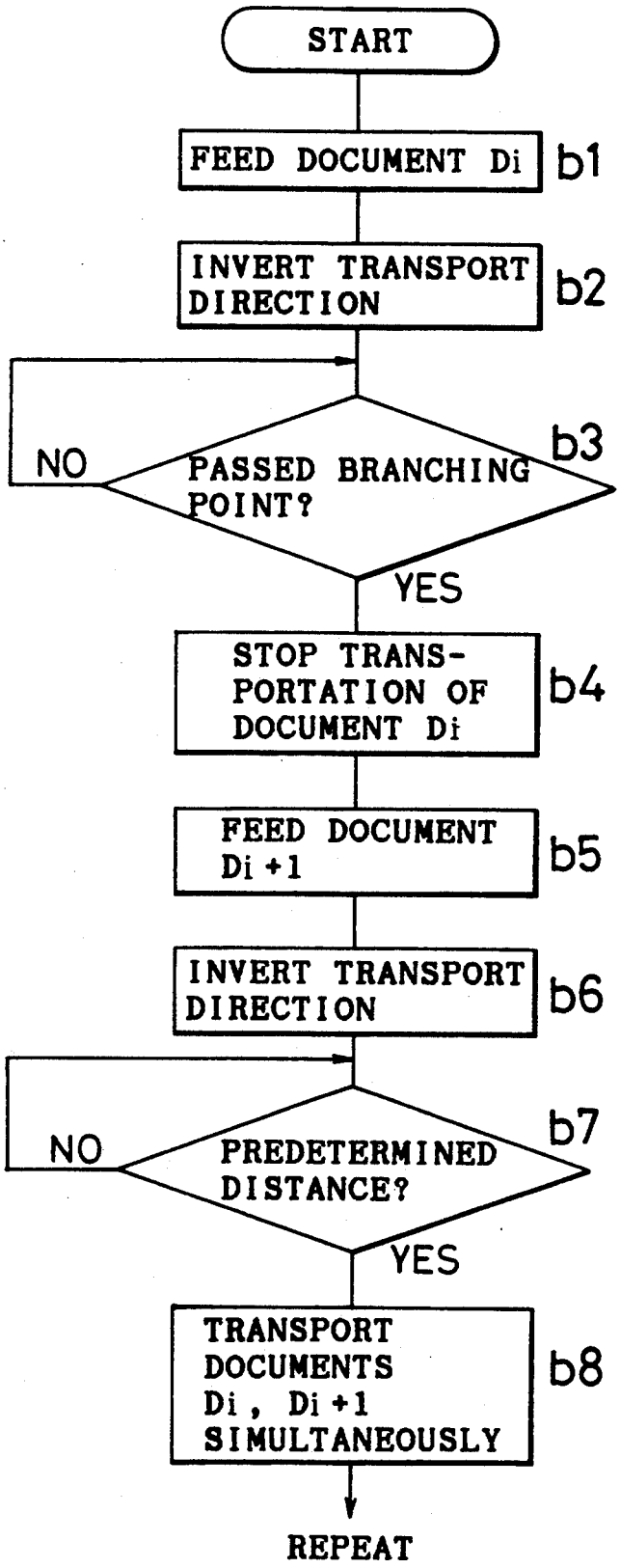
FIG. 9 is a flowchart explaining in outline a second embodiment of the invention.

FIG. 9 is a flowchart explaining in outline a second embodiment of the invention. In step b1, a document Di (i=1,2, . . . ) is fed, and in step b2, the transporting direction of the document Di is inverted. When, in step b3, the trailing edge of the inverted document Di is detected to have passed the branching point at which the diverting pawl 28 is provided, the transportation of the document Di is stopped in step b4.

In step b5, the next document Di+1 is fed, and in step b6, the transporting direction of the document Di+1 is inverted. When, in step b7, the leading edge of the inverted document Di+1 is detected to have come to a predetermined distance from the trailing edge of the stationary document Di, the documents Di and Di+1 are transported together in step b8. Thereafter, the above process is repeated.

Figure 10:
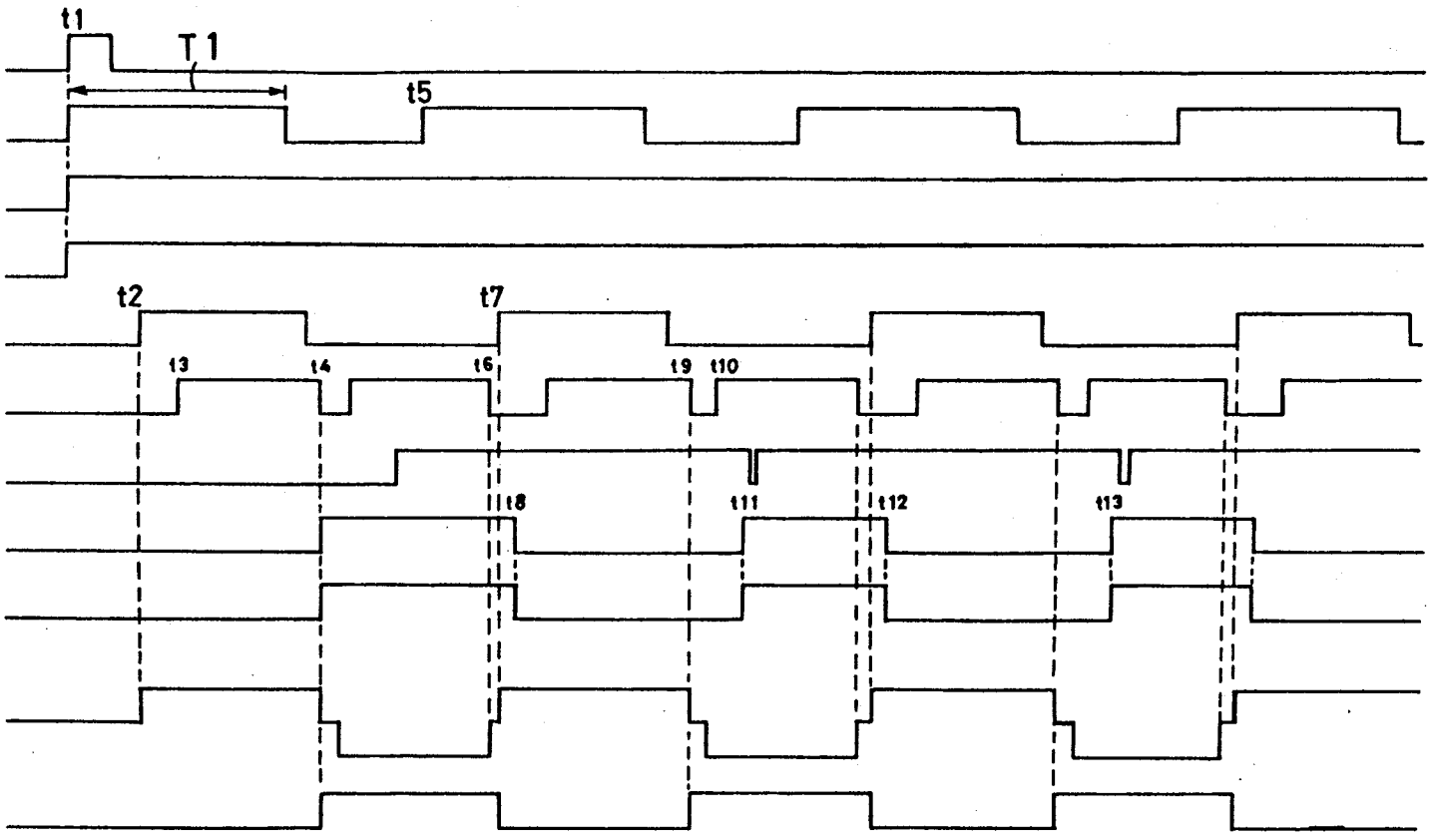
FIGS. 10(1) to 10(11) is a timing chart explaining in detail the document feeding operation according to the second embodiment of the invention.
Figure 11:
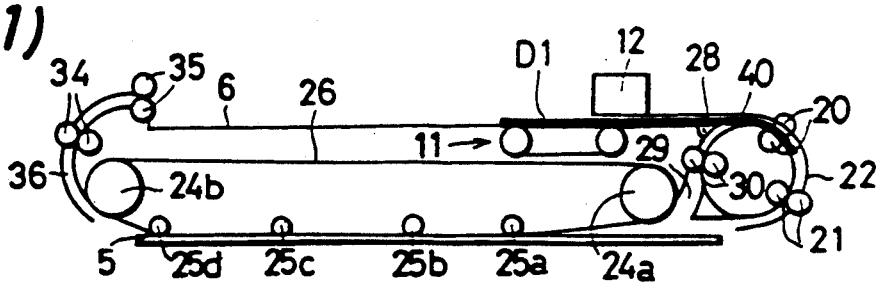
FIGS. 11(1) to 11(7) is a series of diagrams explaining stepwise the transportation of the document.
Figure 11:
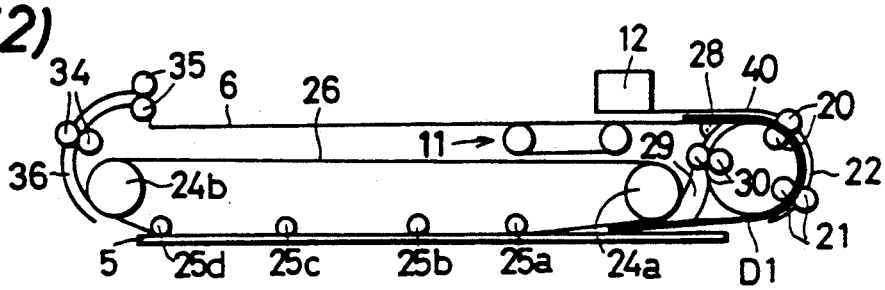
Figure 11:
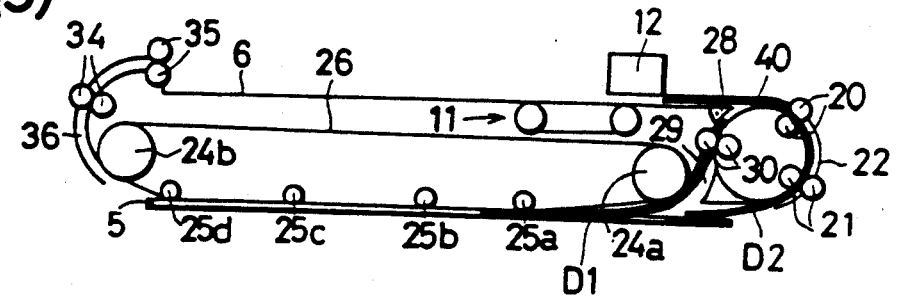
Figure 11:
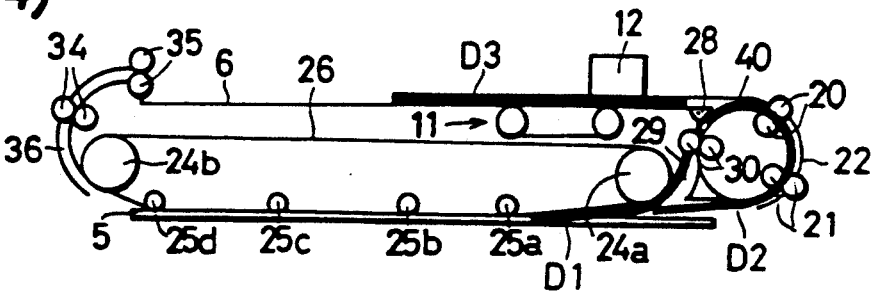
Figure 11:
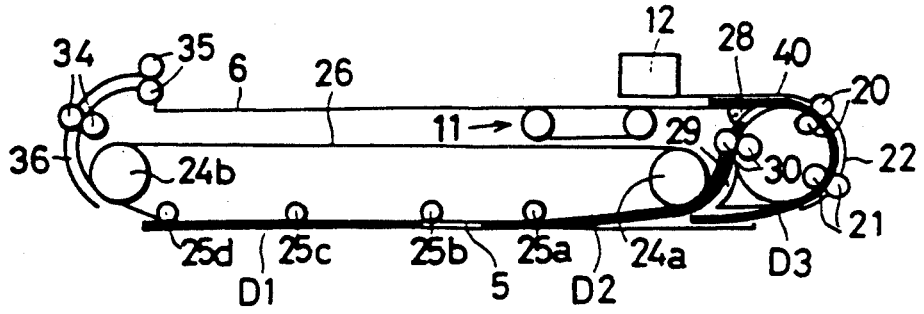
Figure 11:
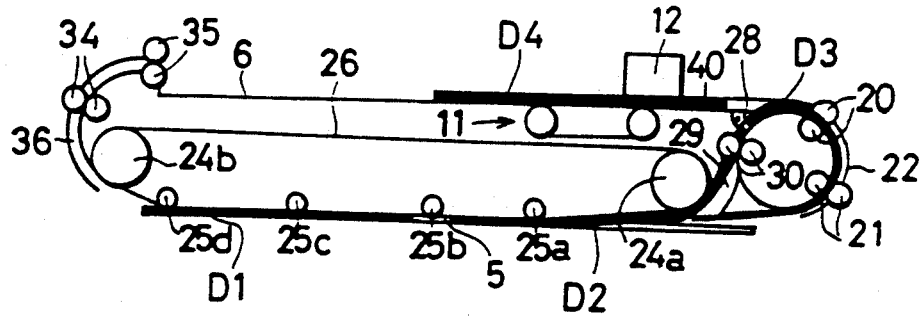
Figure 11:
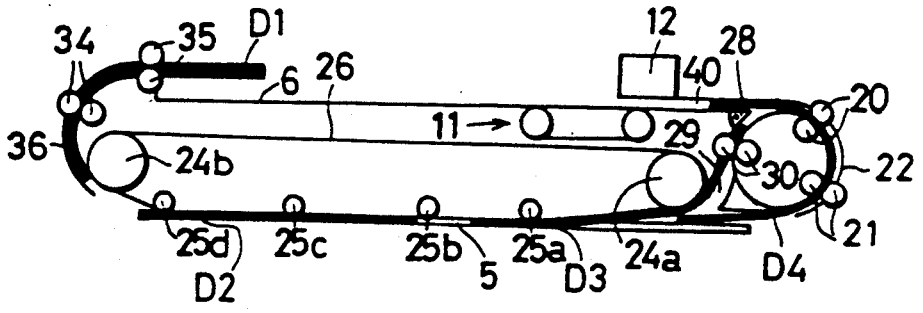

FIG. 10 is a timing chart explaining in detail the document feeding operation according to the second embodiment, and FIG. 11 is a series of diagrams explaining stepwise the transportation of the document D. Referring to FIGS. 10 and 11, the following describes and example of document feeding operation according to this embodiment. FIG. 11 illustrates a case in which four documents D are presented for copying, and the numbers 1–4 suffixed to the reference sign D correspond to the order in which the documents D are fed from the document loading tray 6.

When the duplex (two-sided) documents D1–D4 are placed on the document loading tray 6 with their page numbers collated and the print switch PSW is pressed at time t1 (see FIG. 10(1)), the copy operation is initiated and, as shown in FIG. 11(1), the feeding of the document D is started. As shown in FIGS. 10(2) to (4), the motors M1, M2 and M3 are started at the same time that the print switch PSW is pressed. The motor M1 runs intermittently, for example, for a limited period of time T1 during which the paper feeding means 10 is driven to feed the document D1 from the bottom of the stack on the document loading tray 6. The motors M2 and M3 continue to run until the copy operation is stopped, and drive the transport roller 30, the belts 26, and the transport rollers 20 and 21 as required as the clutches CLT1, CLT2 and CLT3 are controlled to engage and disengage.

At time t2, the first transport detector S1 is activated as the leading edge of the document D1 fed in the transporting direction 7 is detected. In synchronism with the activation of the first transport detector S1, the clutch CLT3 is engaged so that the transport rollers 20 and 21 are rotated in the forward direction to transport the document D1 clockwise along the second transport path 22.

With the solenoid SOL1 in the deenergized state, the diverting pawl 28 is set in the position shown by the solid line in FIG. 2 so that the passage leading from the first transport path 40 to the second transport path 22 is opened. Therefore, the document D1 is directed to the second transport path 22, and at time t3, the second transport detector S2 is activated as the leading edge of the document D1 being transported in the transporting direction 7 is detected. FIG. 11(2) shows the condition immediately after time t3 at which the document D1 is transported into the second transport path 22.

When the trailing edge of the document D1 has passed the first transport detector S1, as shown in FIG. 11(2), the first transport detector S1 is deactivated. At time t4, the second transport detector S2 is also deactivated, which means that the trailing edge of the document D1 transported in the transporting direction 7 has passed the second transport detector S2. At time t4, the solenoid SOL1 is energized. As a result, the diverting pawl 28 is moved to the position indicated by the dotted line in FIG. 2, thereby opening the passage leading from the second transport path 22 to the third transport path 29. Furthermore, at time t4, the clutches CLT1 and CLT2 are engaged so that the rotating force of the motor M3 is transmitted to drive the transport roller 30 and the belts 26.

Next, immediately after time t4, the clutch CLT3 is engaged to rotate the transport rollers 20 and 21 in the reverse direction, thereby inverting the transporting direction of the document D1. With the transporting direction inverted, the document D1 is transported from the second transport path 22 to the third transport path 29. As the transporting direction is inverted, the second transport detector S2 is activated once again when the leading edge of the inverted document D1 passes it, and deactivated at time t6 when the trailing edge thereof passes it. Also at time t6, the solenoid SOL1 is deenergized.

In this embodiment, when a prescribed period of time has elapsed (at time t8) after the trailing edge of the document D1 the transporting direction of which has been inverted in the second transport path 22 has passed the diverting pawl 28, the preliminary feeding of the succeeding document D2 is started in such a manner that the succeeding document D2 is fed into the second transport path 22, as shown in FIG. 11(3), while the clutches CLT1 and CLT2 are disengaged so that the transportation of the document D1 is stopped with the document D1 pressed by the transport roller 30. To accomplish this, the motor M1 that drives to feed the document D2 is started before time t6 (i.e. at time t5), and at time t7, the first transport detector S1 is activated. To transport the succeeding document D2 along the second transport path 22, the transport rollers 20 and 21 are driven again for rotation in the forward direction at time t7, thus transporting the document D2 along the second transport path 22. The second transport detector S2 is then activated as the leading edge of the document D2 is detected.

The first transport detector S1 is deactivated after a length of time corresponding to the size of the document D2 thus transported. At time t9, the second transport detector S2 is also deactivated, which means that the trailing edge of the document D2 transported in the transporting direction 7 has passed the second transport detector S2. At time t9, the clutch CLT3 is disengaged to temporarily stop the transportation of the document D2, while at the same time the solenoid SOL1 is energized to open the passage leading from the second transport path 22 to the third transport path 29. Next, immediately after time t9, the clutch CLT3 is engaged to rotate the transport rollers 20 and 21 in the reverse direction, thereby inverting the transporting direction of the document D2. As the transporting direction of the document D2 is inverted, the second transport detector S2 is activated once again when the leading edge of the inverted document D2 passes it (time t10).

At time t11, when a prescribed period of time has elapsed after time t10, that is, when the leading edge of the document D2 comes to a predetermined distance from the trailing edge of the stationary first document D1 (see FIG. 11(4)), the clutches CLT1 and CLT2 are engaged so that the rotating force of the motor M3 is transmitted to drive the transport roller 30 and the belts 26 to transport the document D1 to the scanning position 5a. At time t12, when a prescribed number of pulses have been counted for example by a rotary encoder or the like after time t11, the clutches CLT1 and CLT2 are disengaged, thus completing the transportation of the document D1 to the scanning position 5a.

In the above operation, the documents D1 and D2 are transported at the same speed so that a constant distance is maintained between the trailing edge of the document D1 and the leading edge of the document D2 during transportation in the transporting direction 23. This distance is selected so that when the document D1 comes to a stop at the document scanning position 5a, the trailing edge of the document D2 is pressed by the stationary transport roller 30 as in the case of the document D1.

FIG. 11(5) shows the condition in which the document D1 has been transported to the scanning position 5a. As shown, the preliminarily fed succeeding document D2 is placed on standby with the leading edge portion thereof sandwiched between the transparent plate 5 and the belts 26. At this time also, the inverting operation by the inverting means is under way to invert the transporting direction of the further succeeding document D3.

Upon completion of the transportation of the document D1 to the scanning position 5a, the optical scanning by the optical system 31 is started, the optical system 31 moving in the direction indicated by arrow 44. While the document D1 is being scanned for exposure, the inverting operation for the succeeding document D3 is performed. FIG. 11(6) shows the condition immediately before time t13, when the scanning of the document D1 is completed and the operation to invert the transporting direction of the document D3 is also completed.

At time t13, the clutches CLT1 and CLT2 are engaged to transport the document D1 into the transport path 36. In the meantime, the document D2 is transported to the scanning position 5a with the document D3 following behind at a predetermined distance from the trailing edge of the document D2. Thereafter, as shown in FIG. 11(7), the document D1 is transported along the transport path 36 by means of the transport rollers 34 and 35 and returned to the document loading tray 6. In the meantime, the document D2 is optically scanned by the optical system 31, while on the other hand, the document D3 is resting with its trailing edge pressed by the transport roller 30. During the scanning of the document D2, the operation to invert the transporting direction of a further succeeding document D4 is performed.

The above sequence of operations is performed sequentially on the successively fed documents D1–D4.

Thus, according to the invention, the transporting forces of the transport paths are individually controlled and effectively coordinated so that the succeeding document can be transported following close behind the preceding document. Therefore, the preliminary feeding of the succeeding document can be completed without fail, with the succeeding document positioned as close as possible to the preceding document, while the preceding document is being scanned for exposure. As a result, the distance that the succeeding document needs to travel to reach the scanning position, and hence the length of time needed to transport the document to that position, is markedly reduced, which eventually leads to a significant reduction in the total time needed to sequentially transport a plurality of documents to the scanning position. Accordingly, the copying time can be reduced markedly.

Figure 12:
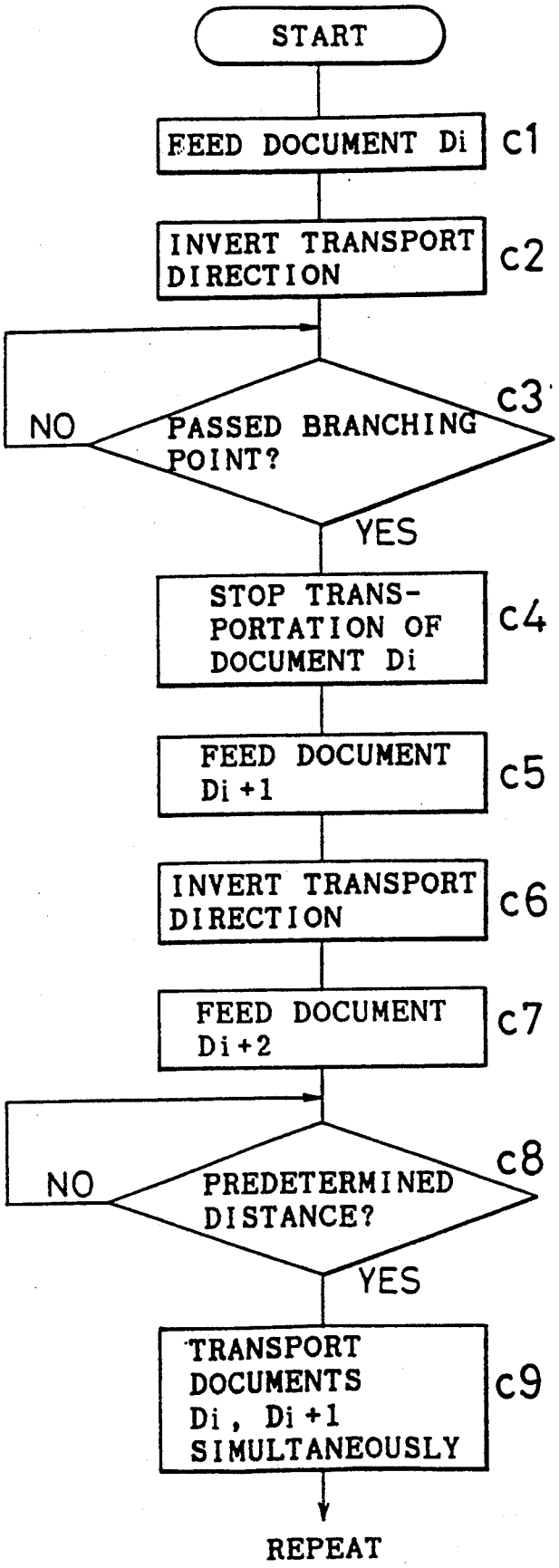
FIG. 12 is a flowchart explaining in outline a third embodiment of the invention.

FIG. 12 is a flowchart explaining in outline a third embodiment of the invention. In step c1, a document Di (i=1,2, . . . ) is fed, and in step c2, the transporting direction of the document Di is inverted. When, in step c3, the trailing edge of the inverted document Di is detected to have passed the branching point at which the diverting pawl 28 is provided, the transportation of the document Di is stopped in step c4.

In step c5, the next document Di+1 is fed, and in step c6, the transporting direction of the document Di+1 is inverted. In step c7, the transportation of a further succeeding document Di+2 is started. When, in step c8, the leading edge of the inverted document Di+1 is detected to have come to a predetermined distance from the trailing edge of the stationary document Di, the document Di and Di+1 are transported together in step c9. Thereafter, the above process is repeated.

Figure 13:
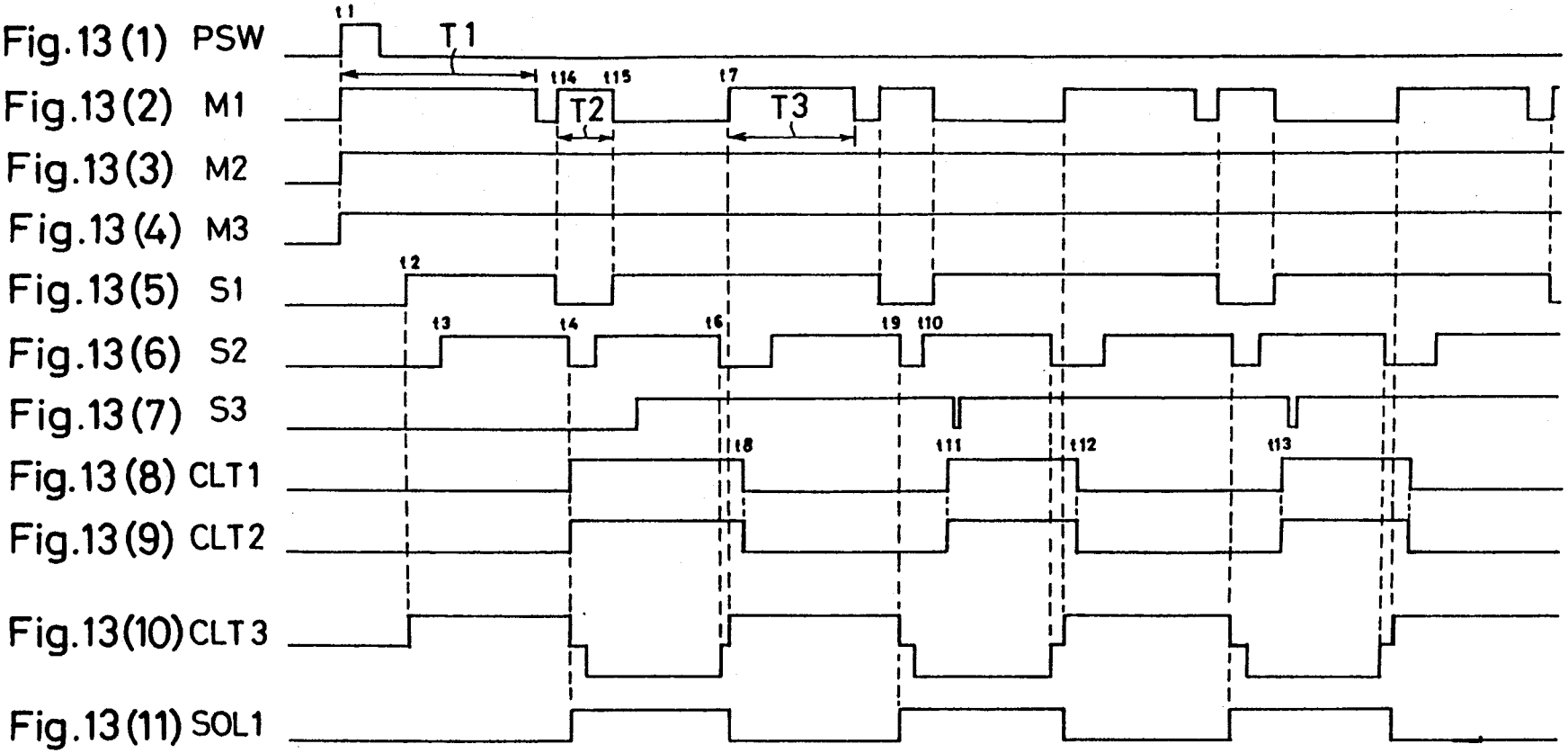
FIGS. 13(1) to 13(11) is a timing chart explaining in detail the document feeding operation according to the third embodiment of the invention.
Figure 14:
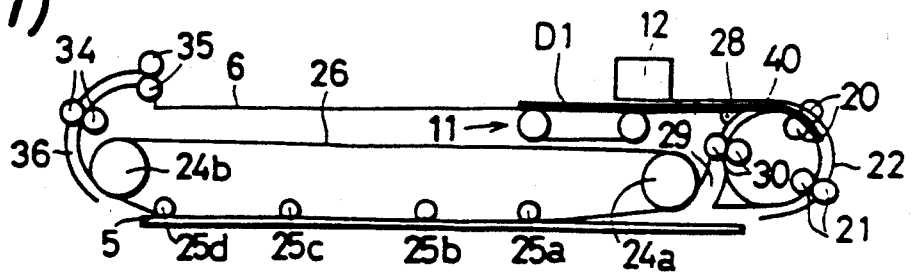
FIGS. 14(1) to 14(7) is a series of diagrams explaining stepwise the transportation of the document D.
Figure 14:
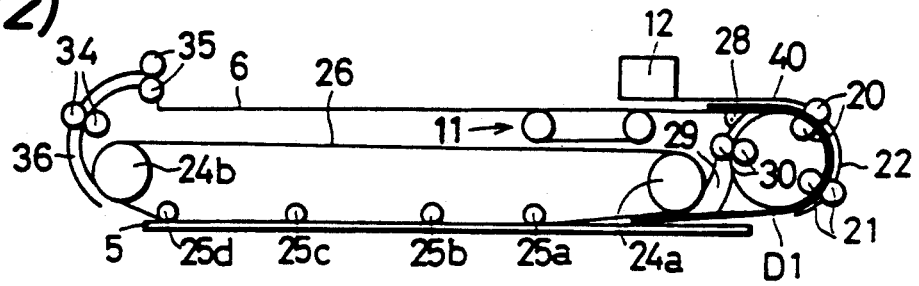
Figure 14:
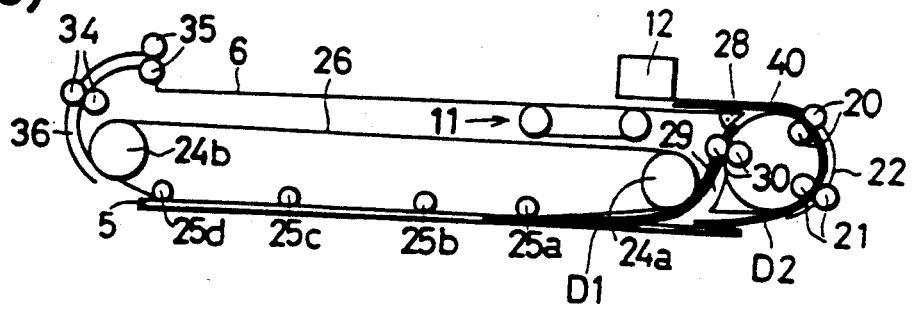
Figure 14:
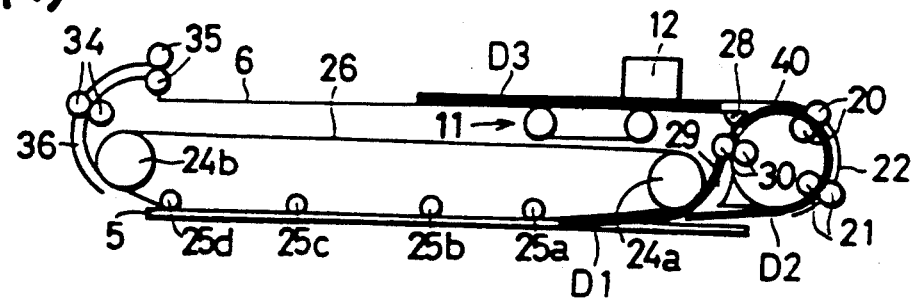
Figure 14:
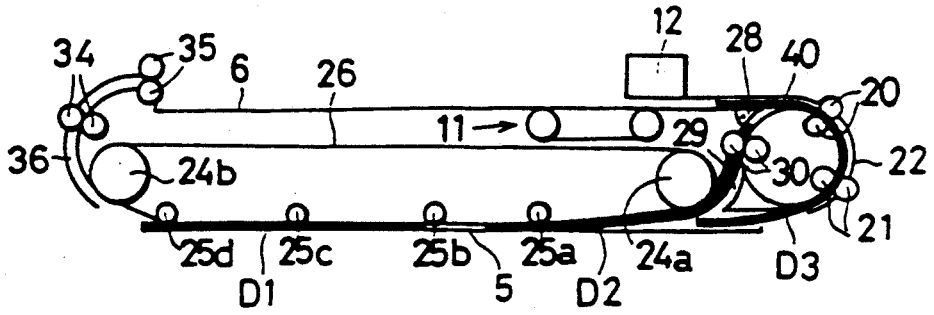
Figure 14:
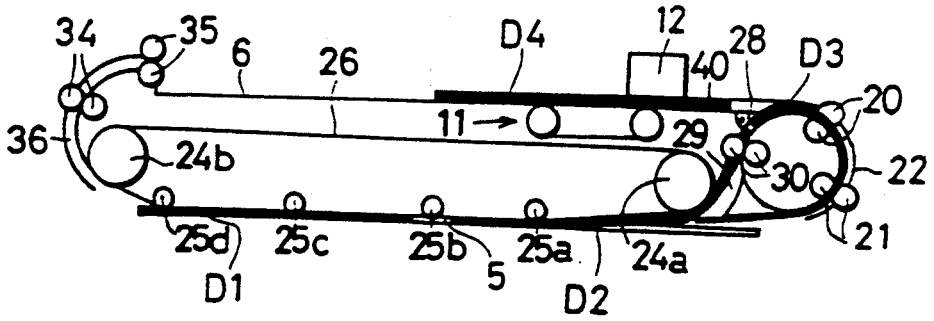
Figure 14:
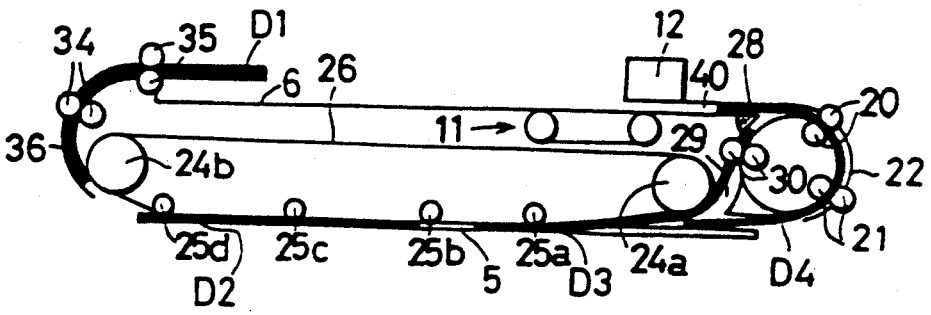

FIG. 13 is a timing chart explaining in detail the document feeding operation according to the third embodiment, and FIG. 14 is a series of diagrams explaining stepwise the transportation of the document D. Referring to FIGS. 13 and 14, the following describes an example of document feeding operation according to this embodiment. FIG. 14 illustrates a case in which four documents D are presented for copying, and the numbers 1–4 suffixed to the reference sign D correspond to the order in which the documents D are fed from the document loading tray 6.

When the duplex (two-sided) documents D1–D4 are placed on the document loading tray 6 with their page numbers collated and the print switch PSW is pressed at time t1 (see FIG. 13(1)), the copy operation is initiated and, as shown in FIG. 14(1), the feeding of the document D is started. As shown in FIGS. 13(2) to (4), the motors M1, M2 and M3 are started at the same time that the print switch PSW is pressed. The motor M1 runs intermittently, to drive the paper feeding means 10 to feed the document D1 from the bottom of the stack on the document loading tray 6. The motors M2 and M3 continue to run until the copy operation is stopped, and drive the transport roller 30, the belts 26, and the transport rollers 20 and 21 as required as the clutches CLT1, CLT2 and CLT3 are controlled to engage and disengage.

At time t2, the first transport detector S1 is activated as the leading edge of the document D1 fed in the transporting direction 7 is detected. In synchronism with the activation of the first transport detector S1, the clutch CLT3 is engaged so that the transport rollers 20 and 21 are rotated in the forward direction to transport the document D1 clockwise along the second transport path 22.

With the solenoid SOL1 in the deenergized state, the diverting pawl 28 is set in the position shown by the solid line in FIG. 2 so that the passage leading from the first transport path 40 to the second transport path 22 is opened. Therefore, the document D1 is directed to the second transport path 22, and at time t3, the second transport detector S2 is activated as the leading edge of the document D1 being transported in the transporting direction 7 is detected. FIG. 14(2) shows the condition immediately after time t3 at which the document D1 is transported into the second transport path 22.

At time t14, when the trailing edge of the document D1 has passed the first transport detector S1, as shown in FIG. 14(2), the first transport detector S1 is deactivated. At time t14, the motor M1 is started to feed the document D2, and at time t15, when the leading edge of the document D2 is detected by the first transport detector S1, the motor M1 is stopped. That is, the motor M1 runs for a limited period of time T2. As a result, the document D2 stops just before reaching the diverting pawl 28.

At time t4, the second transport detector S2 is also deactivated, which means that the trailing edge of the document D1 transported in the transporting direction 7 has passed the second transport detector S2. At time t4 also, the solenoid SOL1 is energized. As a result, the diverting pawl 28 is moved to the position indicated by the dotted line in FIG. 2, thereby opening the passage leading from the second transport path 22 to the third transport path 29. Furthermore, at time t4, the clutches CLT1 and CLT2 are engaged so that the rotating force of the motor M3 is transmitted to drive the transport roller 30 and the belts 26.

Next, immediately after time t4, the clutch CLT3 is engaged to rotate the transport rollers 20 and 21 in the reverse direction, thereby inverting the transporting direction of the document D1. With the transporting direction inverted, the document D1 is transported from the second transport path 22 to the third transport path 29. As the transporting direction is inverted, the second transport detector S2 is activated once again when the leading edge of the inverted document D1 passes it, and deactivated at time t6 when the trailing edge thereof passes it. Also at time t6, the solenoid SOL1 is deenergized.

In this embodiment, when a prescribed period of time has elapsed (at time t8) after the trailing edge of the document D1 the transporting direction of which has been inverted in the second transport path 22 has passed the diverting pawl 28, the preliminary feeding of the succeeding document D2 is started in such a manner that the succeeding document D2 is fed into the second transport path 22, as shown in FIG. 14(3), while the clutches CLT1 and CLT2 are disengaged so that the transportation of the document D1 is stopped with the document D1 pressed by the transport roller 30. To accomplish this, the motor M1 that drives to feed the document D2 is started at time t7. To transport the succeeding document D2 along the second transport path 22, the transport rollers 20 and 21 are driven again for rotation in the forward direction at time t7 for a period of time t3 (T3=T1−T2), thus transporting the document D2 along the second transport path 22. The second transport detector S2 is then activated as the leading edge of the document D2 is detected.

The first transport detector S1 is deactivated after a length of time corresponding to the size of the document D2 thus transported. At the same time, the motor M1 is driven for the period T2 in order to feed the document D3. Next at time t9, the second transport detector S2 is also deactivated, which means that the trailing edge of the document D2 transported in the transporting direction 7 has passed the second transport detector S2. At time t9, the clutch CLT3 is disengaged to temporarily stop the transportation of the document D2, while at the same time the solenoid SOL1 is energized to open the passage leading from the second transport path 22 to the third transport path 29. Next, immediately after time t9, the clutch CLT3 is engaged to rotate the transport rollers 20 and 21 in the reverse direction, thereby inverting the transporting direction of the document D2. As the transporting direction of the document D2 is inverted, the second transport detector S2 is activated once again when the leading edge of the inverted document D2 passes it (time t10).

At time t11 when a prescribed period of time has elapsed after time t10, that is, when the leading edge of the document D2 comes to a predetermined distance from the trailing edge of the stationary first document D1 (see FIG. 14(4)), the clutches CLT1 and CLT2 are engaged so that the rotating force of the motor M3 is transmitted to drive the transport roller 30 and the belts 26 to transport the document D1 to the scanning position 5a. At time t12, when a prescribed number of pulses have been counted for example by a rotary encoder or the like after time t11, the clutches CLT1 and CLT2 are disengaged, thus completing the transportation of the document D1 to the scanning position 5a.

In the above operation, the documents D1 and D2 are transported at the same speed so that a constant distance is maintained between the trailing edge of the document D1 and the leading edge of the document D2 during transportation in the transporting direction 23. This distance is selected so that when the document D1 comes to a stop at the document scanning position 5a, the trailing edge of the document D2 is pressed by the stationary transport roller 30 as in the case of the document D1.

FIG. 14(5) shows the condition in which the document D1 has been transported to the scanning position 5*a*. As shown, the preliminarily fed succeeding document D2 is placed on standby with the leading edge portions thereof sandwiched between the transparent plate 5 and the belts 26. At this time also, the inverting operation by the inverting means is under way to invert the transporting direction of the further succeeding document D3.

Upon completion of the transportation of the document D1 to the scanning position 5*a*, the optical scanning by the optical system 31 is started, the optical system 31 moving in the direction indicated by arrow 44 (see FIG. 2). While the document D1 is being scanned for exposure, the inverting operation for the succeeding document D3 is performed. FIG. 14(6) shows the condition immediately before time t13, when the scanning of the document D1 is completed and the operation to invert the transporting direction of the document D3 is also completed. Also as shown, a further succeeding document D4 has already been transported to a position just before the diverting pawl 28.

At time t13, the clutches CLT1 and CLT2 are engaged to transport the document D1 into the transport path 36. In the meantime, the document D2 is transported to the scanning position 5*a* with the document D3 following behind at a predetermined distance from the trailing edge of the document D2. Thereafter, as shown in FIG. 14(7), the document D1 is transported along the transport path 36 by means of the transport rollers 34 and 35 and returned to the document loading tray 6. In the meantime, the document D2 is optically scanned by the optical system 31, while on the other hand, the document D3 is resting with its trailing edge pressed by the transport roller 30. During the scanning of the document D2, the operation to invert the transporting direction of the document D4 is performed.

The above sequence of operations is performed sequentially on the successively fed documents D1–D4.

Thus, according to the invention, the transporting forces of the transport paths are individually controlled and effectively coordinated so that the succeeding document can be transported following close behind the preceding document. Therefore, the preliminary feeding of the succeeding document can be completed without fail, with the succeeding document positioned as close as possible to the preceding document, while the preceding document is being scanned for exposure. As a result, the distance that the succeeding document needs to travel to reach the scanning position, and hence the length of time needed to transport the document to that position, is markedly reduced, which eventually leads to a significant reduction in the total time needed to sequentially transport a plurality of documents to the scanning position. Accordingly, the copying time can be reduced markedly.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. A document feeding method in which a plurality of document sheets sequentially fed from a document loading tray are first directed into a first branch transport path for inversion of the transporting direction of the document sheets and then transported in successive manner, through a second branch transport path, on to a document scanning area facing an optical scanning means, there being a branching point between the first and second transport paths comprising the steps of:

stopping the transportation of a preceding first document sheet when the trailing edge thereof after inversion has passed the branching point between the two transport paths;

inverting the transporting direction of a succeeding second document sheet; and transporting the first and second document sheets together at the same speed when the leading edge of the inverted second document sheet comes to a predetermined distance from the trailing edge of the stationary first document sheet.

2. A document feeding method in which a plurality of document sheets sequentially fed from a document loading tray are first directed into a first branch transport path for inversion of the transporting direction thereof and then transported in successive manner, through a second branch transport path, on to a document scanning area facing an optical scanning means, there being a branching point between the first and second paths comprising the steps of:

stopping the transportation of preceding first document sheet when the trailing edge thereof after inversion has passed the branching point between the two transport paths;

inverting the transporting direction of a succeeding second document sheet while at the same time transporting a further succeeding third document sheet up to a position near the branching point; and transporting the first and second document sheets together at the same speed when the leading edge of the inverted second document sheet comes to a predetermined distance from the trailing edge of the stationary first document sheet.

3. A document feeding apparatus comprising:

a document loading tray for holding a plurality of document sheets;

document feeding means for feeding the document sheets one by one from the document loading tray;

a first transport path along which the document sheets fed from the document feeding means are transported;

a second transport path formed continuously from the first transport path, there being a joint branching portion between the first and second transport paths;

a third transport path diverging from the joint branching portion between the first and second transport paths and extending into a document scanning area facing an optical scanning means; and means for transporting a preceding first document from the first transport path to the second transport path for inversion of the transporting direction thereof, the first document then being guided into the third transport path, and immediately initiating the feeding of a succeeding second document into the first transport path when the trailing edge of the inverted first document has just passed the branching point of the third transport path.

4. A document feeding apparatus comprising:

a document loading tray for holding a plurality of document sheets;

document feeding means for feeding the document sheets one by one from the document loading tray;

a first transport path along which the document sheets fed from the document feeding means are transported;

a second transport path continuously from the first transport path, there being a joint portion between the first and second transport paths;

a third transport path diverging from the joint portion at a branching point between the first and second transport paths and extending into a document scanning area facing an optical scanning means; and means for transporting a preceding first document from the first transport path to the second transport path for inversion of the transporting direction thereof, the first document then being guided into the third transport path; stopping the transportation of the inverted first document when the trailing edge thereof has passed the branching point of the third transport path, while at the same time inverting the transporting direction of a succeeding second document; and transporting direction of a succeeding second document; and transporting the first and second documents together at the same speed when the leading edge of the inverted second document comes to a predetermined distance from the trailing edge of the stationary first document.

5. A document feeding apparatus comprising:

a document loading tray for holding a plurality of document sheets;

document feeding means for feeding the document sheets one by one from the document loading tray;

a first transport path along which the document sheets fed from the document feeding means are transported;

a second transport path formed continuously from the first transport path, there being a joint portion between the first and second transport paths;

a third transport path diverging from the joint portion at a branching point between the first and second transport paths and extending into a document scanning area facing an optical scanning means; and means for transporting a preceding first document from the first transport path to the second transport path for inversion of the transporting direction thereof, the first document then being guided into the third transport path; stopping the transportation of the inverted first document when the trailing edge thereof has passed the branching point of the third transport path, while at the same time inverting the transporting direction of a succeeding second document and transporting a further succeeding third document up to a position near the branching point; and transporting the first and second documents together at the same speed when the leading edge of the inverted second document comes to a predetermined distance from the trailing edge of the stationary first document.

6. A document feeding apparatus as set forth in claim 3, 4, or 5, wherein:

a diverting pawl, which is switched between a first state that opens the passage from the first transport path to the second transport path and a second state that opens the passage from the second transport path to the third transport path, is provided at the branching point, the diverting pawl being set to the first state when transporting a document delivered from the document loading tray and to the second state when inverting the document transporting direction.

7. A document feeding apparatus as set forth in claim 6, wherein:

a transport roller rotatable in both forward and backward directions is provided in the second transport path, the transport roller being rotated in the forward direction when transporting a document delivered from the document loading tray and in the backward direction when inverting the document transporting direction.

8. A document feeding apparatus as set forth in claim 7, wherein:

a first, a second, and a third document detector each comprising a light emitting element and a light receiving element are provided on the first, second, and third transport paths, respectively, in the vicinity of the branching point, each document detector normally being off and switched on when light is blocked by a passing document and detecting the passing of one document sheet when the detector is switched back to the off state after a predetermined length of time, the diverting pawl and the transport roller being controlled in accordance with the detection result of each document detector.

* * * * *